US007848180B2

(12) United States Patent
Someya et al.

(10) Patent No.: US 7,848,180 B2
(45) Date of Patent: Dec. 7, 2010

(54) ANTENNA APPARATUS, RECEIVING APPARATUS AND WATCH USING MAGNETIC SENSOR

(75) Inventors: Kaoru Someya, Kiyose (JP); Keiichi Nomura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 425 days.

(21) Appl. No.: 11/586,243

(22) Filed: Oct. 25, 2006

(65) Prior Publication Data

US 2007/0097796 A1 May 3, 2007

(30) Foreign Application Priority Data

Oct. 28, 2005 (JP) ..... 2005-314609
Jun. 28, 2006 (JP) ..... 2006-178232

(51) Int. Cl.
*G04C 11/02* (2006.01)

(52) U.S. Cl. ..... 368/47; 343/725

(58) Field of Classification Search ..... 368/47; 343/725

See application file for complete search history.

(56) References Cited

U.S. PATENT DOCUMENTS 4,768,178 A * 8/1988 Conklin et al. ..... 368/47
4,823,328 A * 4/1989 Conklin et al. ..... 368/47
5,764,055 A 6/1998 Kawase
6,020,787 A * 2/2000 Kim et al. ..... 330/279
6,181,922 B1 * 1/2001 Iwai et al. ..... 455/249.1
6,232,775 B1 5/2001 Naitoh et al.
7,103,029 B1 * 9/2006 Minowa ..... 370/342
2001/0010507 A1 8/2001 Hiroshima et al.
2004/0196198 A1 10/2004 Aisenbrey

FOREIGN PATENT DOCUMENTS

EP 0 777 127 A2 6/1997

(Continued)

OTHER PUBLICATIONS

Machine Translation 2000-188558: Source—JPO—19.ipdl.inpit.go.jp/PA1/cgi-bin/PA1INDEX; Nov. 20, 2009.*

(Continued)

*Primary Examiner*—Vit W Miska
*Assistant Examiner*—Sean Kayes
(74) *Attorney, Agent, or Firm*—Holtz, Holtz, Goodman & Chick, PC

(57) ABSTRACT

The antenna circuit 42 includes: an MI magnetic sensor having an electric property which changes in accordance with a magnetic field change; a radio-frequency signal generator S1 to apply a radio-frequency signal to the MI magnetic sensor Z1; an inverter 92 to invert the radio-frequency signal; an adder 94 to reduce the radio-frequency signal by adding the inverted signal with a received signal obtained by the MI magnetic sensor Z1; and detectors D1 and D2 to detect the received signal in which the radio-frequency signal has been reduced. Further, included are a resonant circuit 620 including a magnetic sensor circuit Z1 and a resonant element such as quartz to retrieve a magnetic field change of a resonant frequency from a detected magnetic field change; and a resistance R0. Further, the magnetic sensor circuit 610 includes a magnetoresistance element 612, a DC power source 611 and a resistance R1.

4 Claims, 21 Drawing Sheets

FOREIGN PATENT DOCUMENTS

| | | | |
|---|---|---|---|
| JP | 1-191548 | A | 8/1989 |
| JP | 8-88590 | A | 4/1996 |
| JP | 10-68785 | A | 3/1998 |
| JP | 2000-188558 | A | 7/2000 |
| JP | 2001-33533 | A | 2/2001 |
| JP | 2004-317333 | A | 11/2004 |
| JP | 2006-10542 | A | 1/2006 |

OTHER PUBLICATIONS

Korean Office Action (and English translation thereof) dated Nov. 22, 2007 for counterpart KR 2006-105181.

Hausleitner, Christian, et al, "Cordless Batteryless Wheel Mouse Application Utilizing Radio Requestable Saw Devices in Combination With the Giant Magneto-Impedance Effect" IEEE Transactions on Microwave Theory and Techniques, IEEE Service Center, Piscataway, NJ, vol. 49, No. 4, Apr. 2001, XP011038303, ISSN: 0018-9480. 6 pages.

Japanese Office Action dated Jun. 29, 2010 and English translation thereof, issued in counterpart Japanese Application No. 2006-178232.

Japanese Office Action dated Sep. 14, 2010 and English translation thereof, issued in counterpart Japanese Application No. 2005-314609.

* cited by examiner

ANTENNA APPARATUS, RECEIVING APPARATUS AND WATCH USING MAGNETIC SENSOR

CROSS-REFERENCE TO THE RELATED APPLICATIONS

This application is based upon and claims the benefit of priority from the prior Japanese Patent Application No. 2005-314609, filed on Oct. 28, 2005 and No. 2006-178232, filed on Jun. 28, 2006, the entire contents of which are incorporated herein by reference.

BACKGROUND OF THE INVENTION

1. Field of the Invention

The present invention relates to an antenna circuit using a magnetic sensor and a watch provided with the antenna circuit.

2. Description of Related Art

In recent years, a technique to form an antenna with a magnetic sensor using a magneto-impedance element (MI element) has been proposed (for example, see JP 2000-188558A). As disclosed in JP 2000-188558A, when minute radio frequency current is applied to a soft magnetic material formed in wire shape, ribbon shape or the like, there occurs output voltage across the soft magnetic material due to the impedance thereof. The magneto-impedance effect represents an effect that impedance of soft magnetic material changes sensitively when external magnetic field is applied thereto so that output voltage across the soft magnetic material changes.

FIG. 18 is one example of an antenna circuit to detect magnetism by a magnetic sensor using a MI element (hereinafter referred to as "MI magnetic sensor") and a filter circuit following after the antenna circuit. In the Figure, S1, R1, C1 and Z1 represent a radio-frequency signal generator, a resistance, a condenser and a MI magnetic sensor, respectively. In the magnetism detection circuit of FIG. 18, a radio-frequency signal from the radio-frequency signal generator S1 is distributed to the resistance R1 and MI magnetic sensor Z1, and is output through the condenser C1. When AC magnetic field shown as a dashed line is applied to the MI magnetic sensor Z1, the signal of the radio-frequency signal generator S1 is distributed according to the correlation between the magnetic field and impedance of the MI magnetic sensor shown in FIG. 19A, so that the signal shows magneto-impedance change according to the AC magnetic field. Since the magnetic field changes between plus and minus and the output is based on an even function having an axisymmetric sin curve, the frequency component of the output becomes twice as much as the original frequency.

When fixed magnetic field (see reference numeral 1901) as shown in FIG. 19B is further applied, change of external magnetic field is output with being centered on this fixed magnetic field. Since the curve is approximately linear around the fixed magnetic field in FIG. 19B, the resistance changes in proportion to external magnetic field. That is, since the inversion due to the above-described axisymmetric curve does not occur, the magnetic resistance change have the same frequency.

In the antenna circuit of FIG. 18, the signal at point a is represented as A sin ωt according to S1, and the voltage at point a is represented as Va=A sin ωtZ1/(R1+Z1) according to the magnetic sensor exposed to magnetic field change.

Since the MI magnetic sensor Z1 has variable impedance according to magnetic field change, Z1 can be represented as Z1=Z(1+B sin pt). Here, since B<<1, the equation of Va can be transformed as follows.

$$\begin{aligned} Va &= A\sin\omega t \cdot Z1(R1 + Z1) \\ &= A\sin\omega t \cdot Z(1 + B\sin pt)/(R1 + Z(1 + B\sin pt)) \\ &\approx A\sin\omega t \cdot Z(1 + B\sin pt)/(R1 + Z) \end{aligned} \tag{1}$$

Formula (1) has the same format as that of amplitude modulation (AM), which shows that the signal of the radio-frequency signal generator S1 is subject to amplitude modulation according to magnetic field frequency. On the other hand, the signal of the radio-frequency signal generator S1 is a radio-frequency signal for generating skin effect of the magnetic sensor. The impedance change in the magnetic sensor modulates the signal of the radio-frequency signal generator S1. As shown in FIG. 20A, the signal of the radio-frequency signal generator S1 is modulated to be a state represented by reference numeral 2002 according to magnetic field change (see reference numeral 2000). Thus, a waveform as shown in FIG. 10A is propagated from point a or the condenser C1. By employing a configuration to receive this waveform with a circuit equivalent to a AM receiver, it becomes possible to receive magnetic field change. Here, since the modulated signal has been subject to amplitude modulation, there occurs side bands 2011 and 2012 with respect to a carrier signal 2010 as shown in FIG. 20B. Since these side bands changes according to magnetic field change, it is preferable to detect them. However, as shown in formula (1), the value of B is very small (several percent), the side bands are extremely small with respect to the carrier.

Here, receiver sensitivity is to be considered. When it is assumed a general wave clock has receiver sensitivity of 40 dBμ/m for example, the sensitivity can be converted to $10^{-8}$Oe (1Oe≈79.6 A/m). According to a magnetic permeability of vacuum, it can be regarded that 1Oe≈1G. Accordingly, it is required that an antenna applied to a wave clock has sensitivity of $10^{-8}$G.

However, a MI sensor of earlier development having a normal sensor shape has sensitivity of about 50 mV/G. Even if the sensor can detect 1 μV signal, detection of magnetic field becomes $1/(5\times10^4)$ thereof. That is, although $10^{-8}$ G receiving sensitivity is required, only reception at $2\times10^{-5}$ G sensitivity is possible. Thus, a MI sensor of earlier development is lacking in sensitivity for a wave clock.

In order to improve sensitivity, the following means could be given.

(1) To devise shape of a MI sensor itself to reduce effect of demagnetizing field.

(2) To improve detection accuracy of side bands

An object of the present invention is to improve detection accuracy of side bands, so as to provide a receiving apparatus which can detect a desired signal from received electric wave and a watch provided with the receiving apparatus.

For example, it is assumed that a received signal (40 KHz) has C/N of 140 dB with respect to a 20 MHz signal of the radio-frequency signal generator S1, and that the signal of S1 is applied to the resistance R1 at 3 Vrms. It is preferable for reducing power consumption that impedance of S1 side at a point (point a) between the resistance R1 and MI magnetic sensor Z1 is large. Accordingly, when it is assumed that R1=Z1=1 MΩ, the impedance of S1 side becomes 500 kΩ. In this case, thermal noise value Vn is given as follows when it is assumed that bandwidth B is 10 Hz and absolute temperature T is 300.

$$\begin{aligned} Vn &= 20\log\sqrt{(4kBTR)} \\ &= -77.8\ \text{dB}\mu + 10\log(BR) \\ &= -77.8 + 67.0 \\ &= -10.8\ \text{dB}\mu \\ &= 0.29\ \mu\text{Vrms} \end{aligned}$$

The total noise value is 3.01 μVrms, and applied signal noise is predominant among them.

In order to reduce the above thermal noise, application of signal correlation is known. Thus, synchronous detection may be employed using a phase comparator 81, a low-pass filter 82, a oscillator 83 and a mixer 84 as shown in FIG. 21, instead of the envelope detector circuit provided with diodes D1 and D2 as shown in FIG. 18. However, in the synchronous detection of earlier development as shown in FIG. 21, it is problematic that synchronization using the phase comparator 81 and oscillator 83 is difficult due to noise.

Further, a magnetic sensor disclosed in JP 2000-188588A detects magnetic field change in wide frequency range because of lacking filter property. Thus, it is impossible to detect only magnetic field change at specific frequency.

Such configuration requires a tuning circuit to select desired frequency component provided at a later stage of an antenna section. Moreover, since such receiving apparatus uses an MI sensor, it requires a radio-frequency AC power source (driving circuit) to drive a magneto-impedance element. As a result, size of the antenna section becomes comparatively large.

It is an object of the present invention to provide an antenna circuit in which detection accuracy of side bands is improved by reducing noise from a radio-frequency signal generator with a comparatively simple circuit, and a watch provided with the antenna circuit.

It is also an object of the present invention to downsize an antenna apparatus, a receiving apparatus and electronic equipment, without decreasing the receiving sensitivity thereof.

SUMMARY OF THE INVENTION

According to one aspect of the invention, a radio-frequency signal is applied to a magnetic field detecting unit having an electrical property which changes in accordance with a magnetic field change, at least a part of the radio-frequency signal is reduced from the obtained received signal, and the processed received signal is detected.

According to another aspect of the invention an antenna apparatus comprises: an detecting circuit to detect a received signal obtained by applying a radio-frequency signal to an magnetic field detecting element having an electric property which changes in accordance with magnetic field change, wherein the detecting circuit comprises a synchronous detection circuit to take in the radio-frequency signal or a level-adjusted radio-frequency signal and perform a synchronous detection with the taken-in signal.

According to another aspect of the invention, a signal corresponding to a standard frequency broadcast including time information, which is obtained by the above-described antenna apparatus, is amplified, and the amplified signal is detected and demodulated. Time information is extracted from the demodulated signal, and a time counted by a time counting circuit is corrected based on the extracted time information.

According to another aspect of the invention, a magnetic field detecting element having an electric property which changes in accordance with a magnetic field change and a resonant circuit connected with the magnetic field detecting circuit are included, a magnetic field change of a predetermined frequency is retrieved as an electric signal from a magnetic field change which is detectable by the magnetic field detecting element with a resonant effect of the resonant circuit, and the retrieved signal is a received signal of an electric wave of the predetermined frequency.

According to another aspect of the invention, a magnetic field detecting element having an electric property which changes in accordance with a magnetic field change and a resonant circuit connected with the magnetic field detecting circuit are included, a magnetic field change of a predetermined frequency is retrieved as an electric signal from a magnetic field change which is detectable by the magnetic field detecting element with a resonant effect of the resonant circuit, the retrieved signal is a received signal of an electric wave of the predetermined frequency, and the received signal is amplified and detected.

According to another aspect of the invention, a time counting circuit to count time, time display unit to display time counted by the time counting unit, a magnetic filed detecting element having an electric property which changes in accordance with a magnetic field change, and a resonant circuit connected with the magnetic field detecting circuit are included. A carrier signal carrying time information is retrieved from a magnetic field change which is detectable with the magnetic field detecting element is amplified and detected. The time information is extracted from the amplified and detected signal, and the time counted by the time counting circuit is corrected based on the extracted time information.

DETAILED DESCRIPTION OF THE PREFERRED EMBODIMENT

[Wrist Watch]

Figure 1:
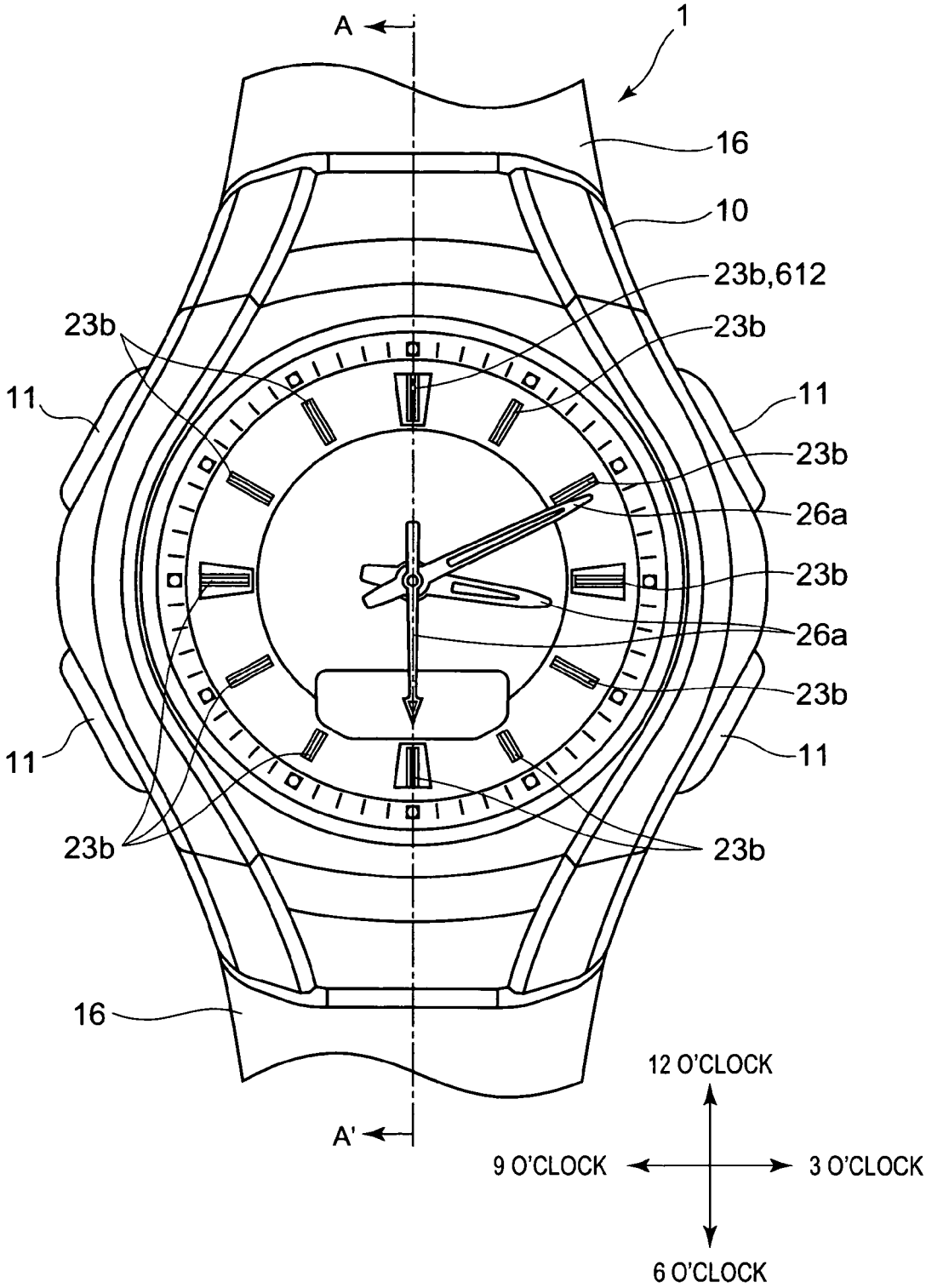
FIG. 1 is a front view of a watch provided with a receiving circuit of the present embodiment.
Figure 2:
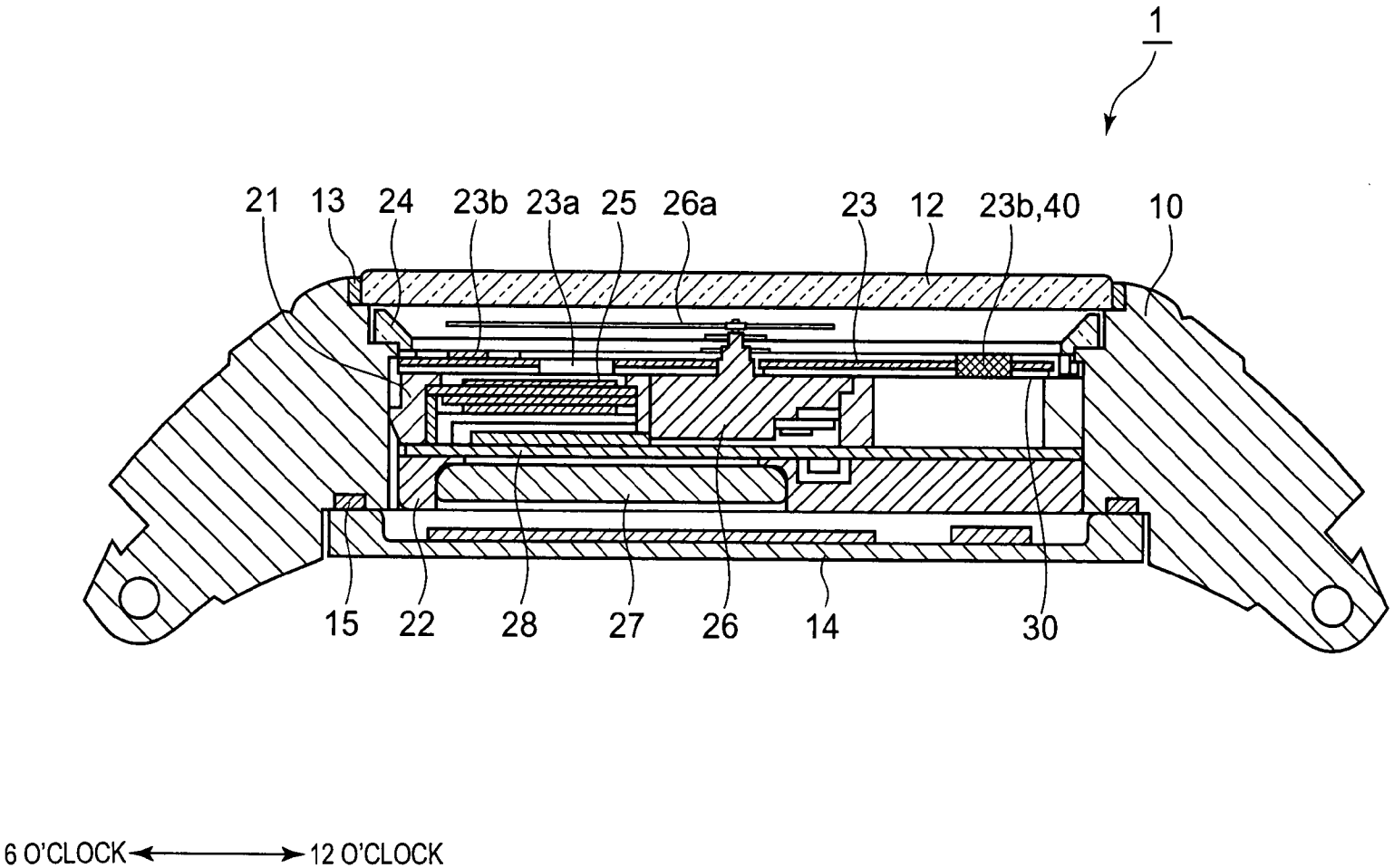
FIG. 2 is a cross section view of FIG. 1 along with line A-A' (a cross section view along with twelve-six)

Hereinafter, embodiments of the present invention will be described with reference to the attached drawings. FIGS. 1 and 2 are a front view of a wrist watch provided with a receiving circuit of the present embodiment and a cross section view thereof along with line A-A' (cross section view along with twelve-six), respectively. A wrist watch 1 comprises a watch case 10 to house a watch module and the like to inside thereof. A watch band 16 for a user to wear the wrist watch on his wrist is attached to a circumference of the watch case 10 at the positions of twelve and six o'clock. A switch 11 to execute various functions of the wrist watch 1 is provided on a circumference side wall of a wrist watch 10.

The watch case 10 is made of metal such as stainless steel and titan, and is formed to be a ring-shaped short column. Protrusions to attach the watch band 16 are formed at the positions lateral to each of six and twelve o'clock positions, and holes to fit in pins to attach the watch band 16 are formed on the protrusions.

A watch glass 12 is fitted on the upper end of the watch case 10 via a sealing member 13 so as to cover the upper end. A case back 14 is attached on the lower end of the watch case 10 via a gasket 15 so as to cover the lower end. The case back 14 is approximately a thin plate made of a metal having high strength.

An upper housing 21 and a lower housing 22 are disposed to inside of the watch case 10, where each of the circumferences thereof is attached to a middle frame provided on an inner circumference of the watch case 10.

A printed-wiring assembly 30 is disposed on an upper face of the upper housing 21, and a dial 23 is disposed on the printed-wiring assembly 30. A ring-shaped dial cover 24 is disposed on an upper face of the dial 23 with being contacted to peripheral edge of the watch glass. A liquid crystal display panel 25 is disposed below a opening 23*a* which is formed on the dial 23 at a position near six o'clock, the panel being supported by the upper housing 21. That is, when the watch 1 is seen from the front side, time displayed on the liquid crystal display 25 can be observed visually through the watch glass 12.

On an upper face of the dial 23, twelve marks 23*b* formed in approximately rectangular shape in their plain view are provided at even internals in circumference direction. These marks 23*b* correspond to 1 to 12 o'clocks respectively. In the present embodiment, an MI magnetic sensor 40 using a magnetoresistance element whose magnetoresistance changes according to external magnetic field is formed at the mark 23*b* corresponding to 12 o'clock among these marks 23*b*. This MI magnetic sensor 40 functions as an antenna to receive standard frequency broadcast. The MI magnetic sensor 40 comprises a magnetic material patterned on an upper surface of the printed-wiring assembly 30, and the upper face of the MI magnetic sensor 40 is exposed from an opening formed on a dial plate 23 at the corresponding position.

The upper housing 21 comprises an analogue clock hands mechanism 26 approximately at a center of the watch case 10. The analogue clock hands mechanism 26 comprises a hand spindle projected upwardly from a spindle hole formed at the center of the dial 23 and clock hands 26*a* such as an hour hand and minute hand, and moves the clock hands 26*a* over the dial 23.

A battery 27 is incorporated in the lower housing 22. The analogue clock hands mechanism 26 and a circuit board 28 connected to the antenna circuit 42 are disposed between the upper housing 21 and lower housing 22.

Various circuit components are disposed on the circuit board 28. The circuit components include a control IC such as a CPU, a time count circuit comprising a oscillator circuit to count current time, and an antenna circuit (the MI magnetic sensor 40 of the antenna circuit is formed in the mark 23*b*), and also include a receiving circuit including the antenna circuit to amplify and detect an output signal of the antenna circuit so as to retrieve a time code signal included in the standard frequency broadcast. The control IC corrects the current time of the time count circuit based on the time code in the signal retrieved by the receiving circuit, and displays the corrected time to the liquid display panel 25. Alternatively, the control IC controls the analogue clock hands mechanism 26 to move the clock hands 26*a*.

[Circuit Configuration]

Figure 3:
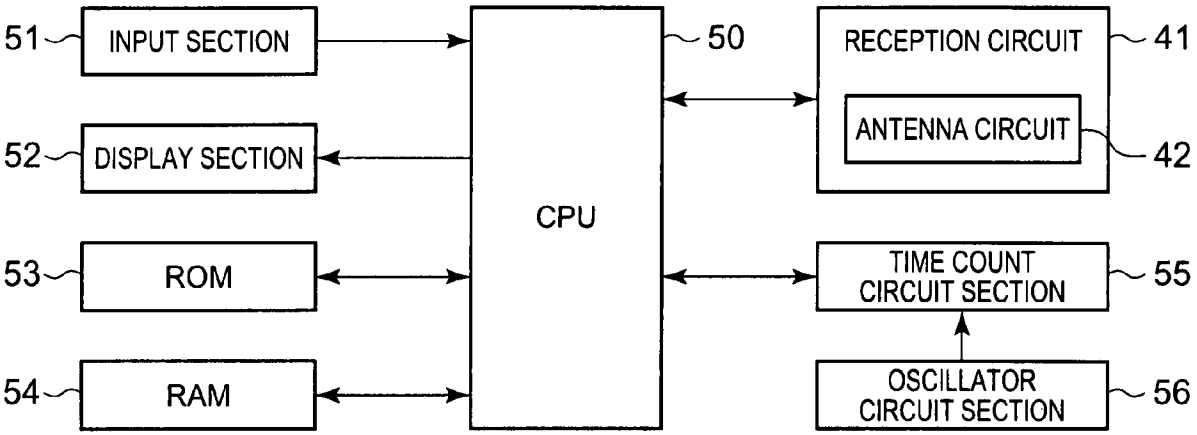
FIG. 3 is a block diagram showing an internal configuration of a circuit of a wrist watch 1 of the present embodiment.

FIG. 3 is a block diagram showing internal configuration of the circuit of the wrist watch 1 according to the present invention. As shown in FIG. 3, the wrist watch 1 comprises a CPU 50, an input section 51, a display 52, a ROM 53, a RAM 54, a receiving circuit 44, a time count circuit section 55 and an oscillator circuit section 56.

The CPU 50 reads out a program stored in the ROM 53 at a predetermined timing or according to an operation signal input from a input section 200, expands it to the RAM 54, and executes directions to the components of the wrist watch 1 and transfer of a data. Specifically, the CPU 50 controls the receiving circuit 44 in predetermined time intervals to receive standard frequency broadcast and corrects a current time data counted in the time count circuit section 55 based on the time code signal from the receiving circuit 44. Further, the CPU 50 transfers the current time counted by the time count circuit section 55 to the display 52.

The input section 51 includes a switch 11 to accept directions to execute various functions of the wrist watch 1. When the switch 11 is operated, it outputs a corresponding operation signal to the CPU 50. The display 52 includes the dial 23, analogue clock hands mechanism 26 controlled by the CPU 50 and liquid crystal display 25. The display 52 displays the current time counted by the time count circuit section 55. The ROM 53 stores a system program, application program and data to operate the wrist watch 1 and to realize a predetermined function. The RAM 54 functions as a working area of the CPU 50, and temporarily stores a program and data read out from the ROM 53 and a data processed by the CPU 50.

As is described in detail below, the receiving circuit 44 includes the antenna circuit 42, and retrieves a signal of a predetermined frequency from the signal received by the antenna circuit 42 and outputs the retrieved signal to the CPU 50. The time count circuit section 55 counts the current time by counting the signal input from the oscillator circuit section 56, and outputs a current time data to the CPU 50. The oscillator circuit section 56 constantly outputs a clock signal of constant frequency.

Figure 4:
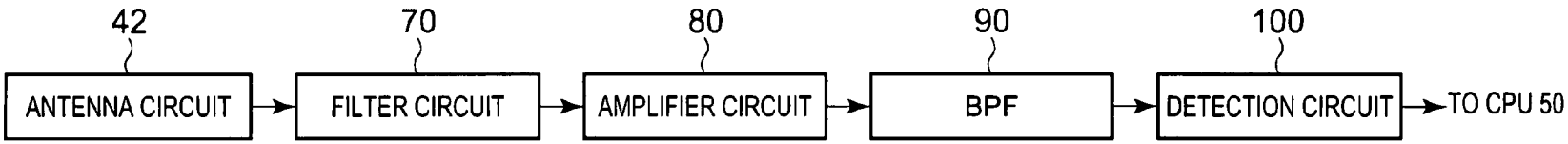
FIG. 4 is a block diagram showing an outline of a receiving circuit 44 of the present embodiment.

FIG. 4 is a block diagram showing an outline of the receiving circuit 44. As shown in FIG. 4, the receiving circuit 44 comprises the antenna circuit 42, a low-pass filter (LPF) 70, an amplifier circuit 80, a LPF 90 and a detection circuit 100.

Figure 5:
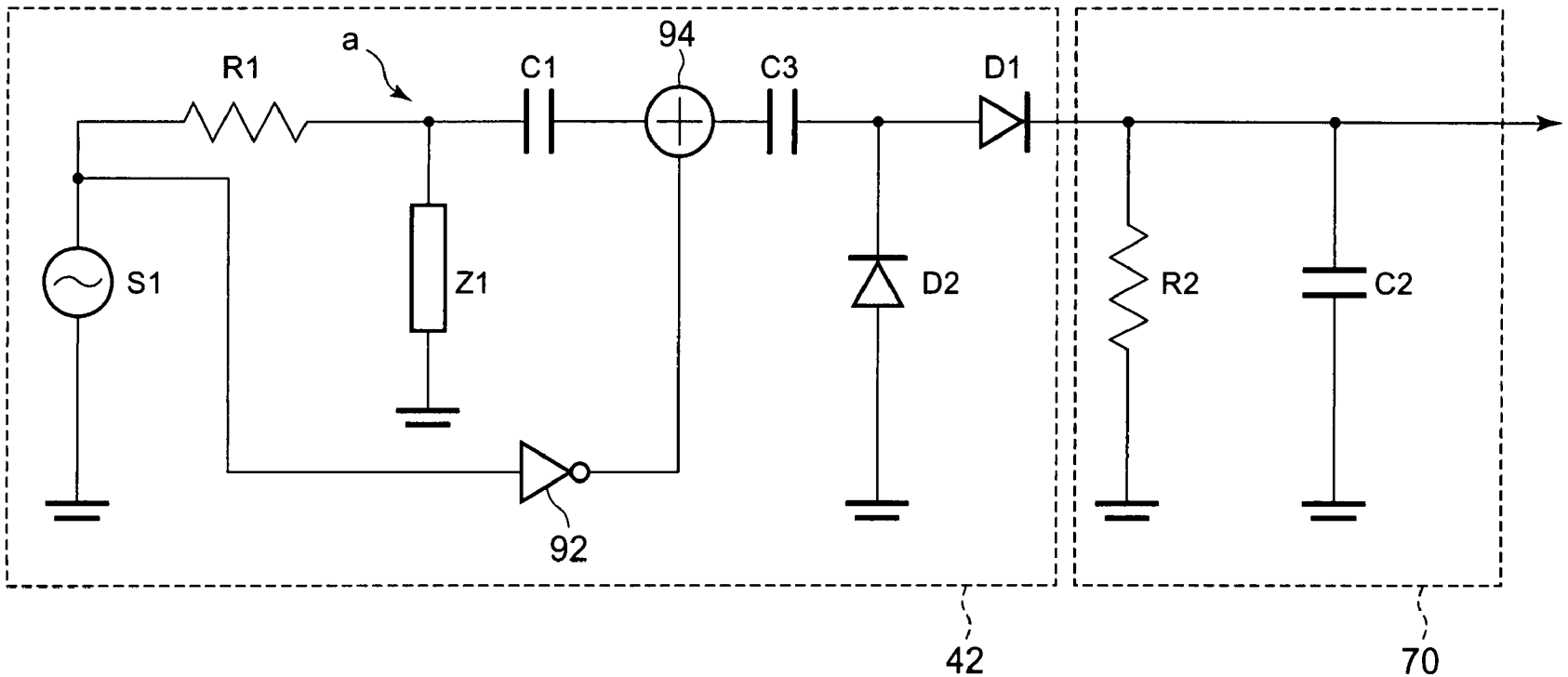
FIG. 5 shows an antenna circuit and a LPF following after the antenna circuit of a first embodiment.

The antenna circuit 42 includes, as shown in FIG. 5, the radio-frequency signal generator S1, resistance R1, MI magnetic sensor Z1 (reference numeral 40 in FIG. 1), condenser C1 and diodes D1 and D2.

As described above, the antenna circuit 42 outputs the signal corresponding to standard frequency broadcast, and the signal is input to the detection circuit 100 through the LPF 70, amplifier circuit 80 and LPF 90. The detection circuit 100 demodulates the signal of standard frequency broadcast. The demodulated signal is input to and decoded in the CPU 50 to extract time information.

FIRST EMBODIMENT

Figure 18:
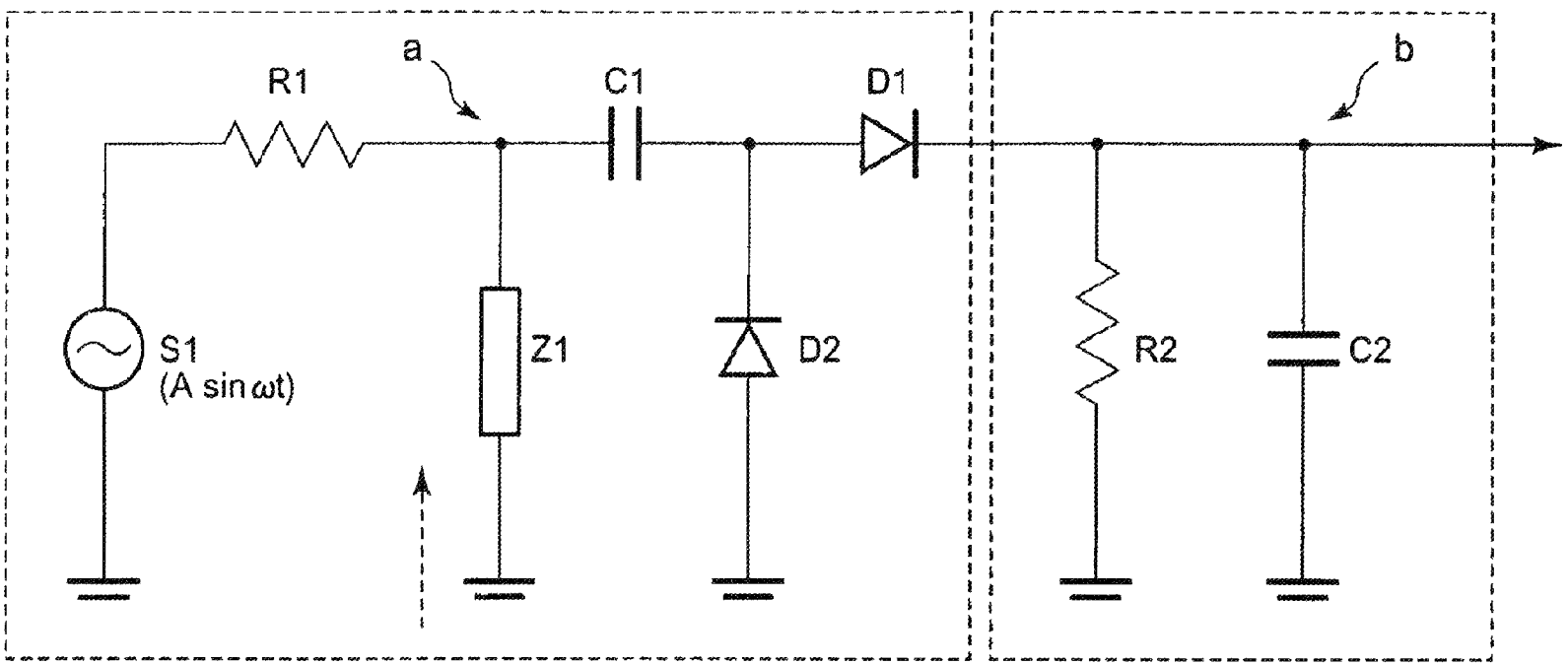
FIG. 18 PRIOR ART
FIG. 18 shows one example of an antenna circuit which detects magnetic field by using a MI magnetic sensor and a filter circuit following after the antenna circuit.
Figure 19A:
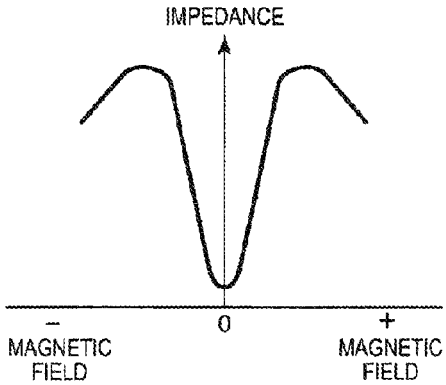
FIG. 19A PRIOR ART
FIGS. 19A and 19B show a correlation between magnetic field and impedance.
Figure 19B:
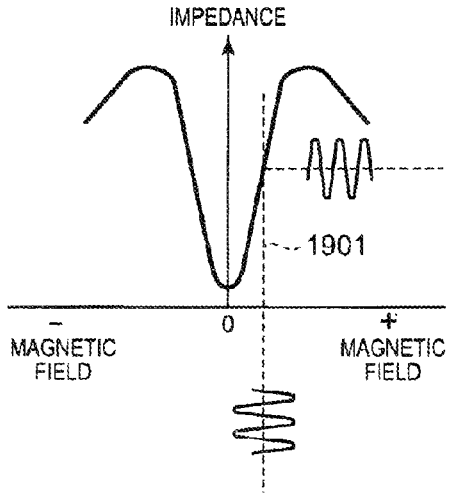
FIG. 19B PRIOR ART

Hereinafter, the antenna circuit of the present invention is described in more detail. FIG. 5 shows an antenna circuit and a LPF following after the antenna circuit of the first embodiment. As shown in FIG. 5, the antenna circuit 42 of the first embodiment comprises a radio-frequency signal generator S1, a resistance R1, a condenser C1, a MI magnetic sensor Z1 and diodes D1 and D2, as same as the antenna circuit shown in FIG. 18.

The radio-frequency signal generator S1 generates 20 MHz signal, for example. The radio-frequency signal generator S1 is connected to one end of the resistance R1. The other end of the R1 is connected to each one end of the MI magnetic sensor Z1 and condenser C1. The diodes D1 and D2 function as an envelope detector circuit.

In the present embodiment, the antenna circuit 42 further comprises an inverter 92 to take in a radio-frequency signal from the radio-frequency signal generator S1, to invert the input radio-frequency signal and to output an inversion signal, and an adder 94 placed between the other end of the condenser C1 and the envelope detector circuit in which one input terminal is connected to the other end of the condenser C1, the other input terminal is connected to an output of the inverter 92 and an output terminal is lead to the envelope detection circuit. The LPF 70 connected after the antenna circuit 42 is as same as that shown in FIG. 18.

Operation of the antenna circuit 42 of such configuration is explained. As described above, voltage Va at point a of the antenna circuit 42 can be represented as follows.

$$Va \approx A \sin \omega \cdot Z(1+B \sin pt)/(R1+Z) \quad (1)$$

(A sin ωt: signal of the radio-frequency signal generator S1, Z(1+B sin pt): signal of the magnetic sensor)

Figure 6A:
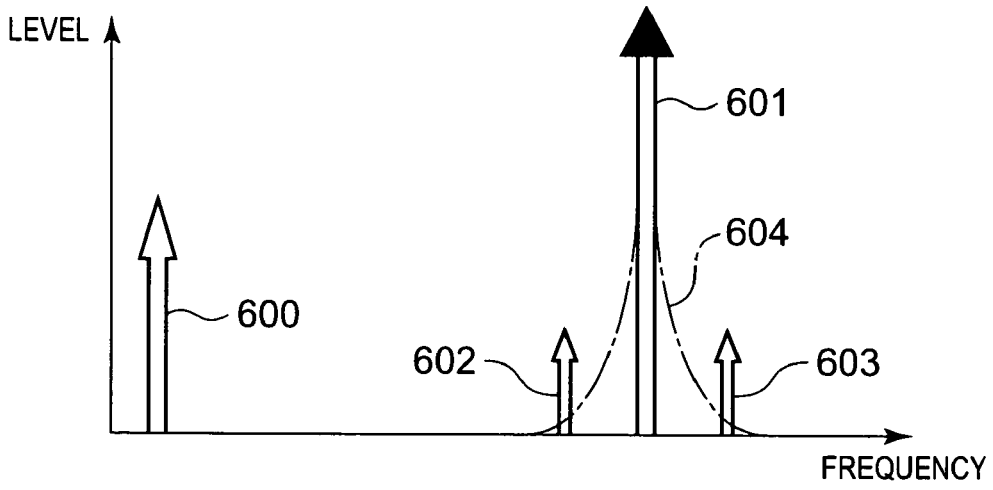
FIGS. 6A and 6B are views to explain frequency component of a modulated signal.
Figure 6B:
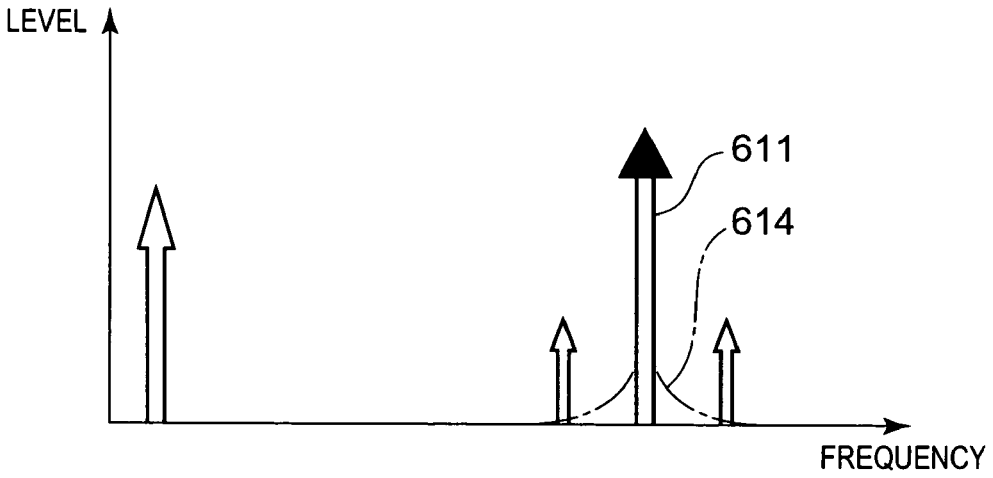

As shown in formula (1), the modulated signal has the same formula as that of amplitude modulation, and the formula shows that the signal of S1 is subject to amplitude modulation according to magnetic field frequency. Therefore, as shown in FIG. 6B, side bands 602 and 603 occurs both sides of a carrier signal 601 of the radio-frequency signal generator S1. In FIG. 6A, reference numeral 600 represents a receiving signal of standard frequency broadcast. Since the carrier signal includes an applied signal noise (see reference numeral 604), it is difficult to detect the side bands due to this noise. In the present embodiment, an inversion signal of the carrier signal of the radio-frequency signal generator S1 is added to the modulated signal, so that the carrier signal level is reduced as shown in FIG. 6B (see reference numeral 611 of FIG. 6B). Since the noise component is also reduced according to the reduction of the carrier signal level, it becomes easy to detect the side bands.

It is preferable that the inversion signal level is determined so that the carrier signal level of the modulated signal after adding the inversion signal is more than twice as much as the side bands level thereof. By doing so, the modulated signal after adding the inversion signal is not overmodulated, and the signal can be detected with the envelope detector circuit as shown in FIG. 5.

According to the present embodiment, the MI magnetic sensor drives with a radio-frequency signal to generate the modulated signal according to magnetic field change. The inversion signal of the radio-frequency signal is synthesized to the modulated signal to cancel the carrier signal, i.e. radio frequency signal. As a result, it becomes possible to extract side bands with high purity, and to improve sensitivity of the antenna circuit.

SECOND EMBODIMENT

Figure 7:
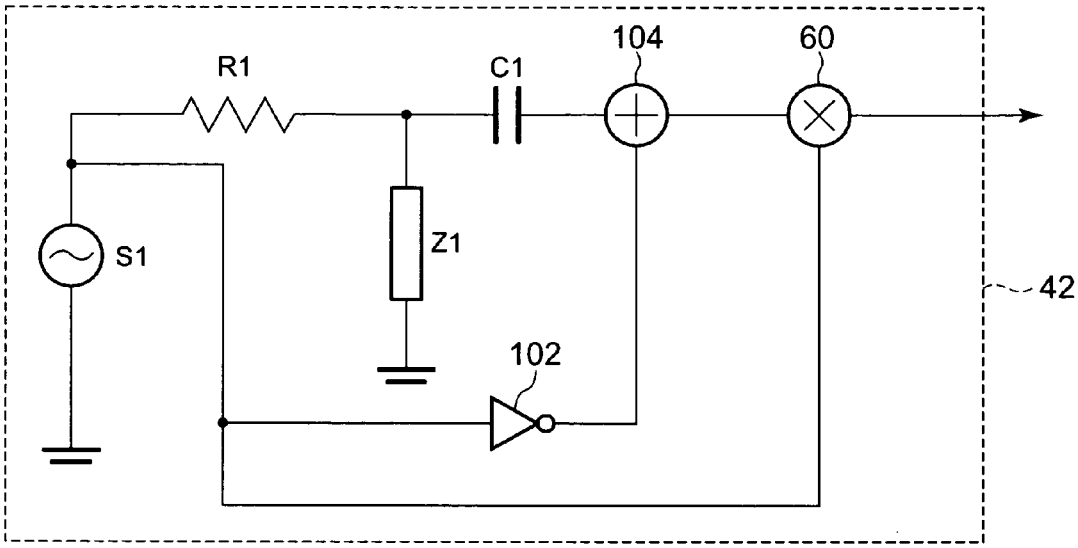
FIG. 7 shows an antenna circuit of a second embodiment.

Next, a second embodiment of the present invention is described. FIG. 7 shows an antenna circuit of the second embodiment of the present invention. Similar to the first embodiment, an antenna circuit 42 comprises a radio-frequency signal generator S1, a resistance R1, a condenser C1 and an MI magnetic sensor Z1. Further, the antenna circuit 42 of the second embodiment comprises, similar to the first embodiment, an inverter 102 to invert a radio-frequency signal from the radio-frequency signal generator S1 to output an inversion signal, and an adder 104 in which one input terminal is connected to the other end of the condenser C1, the other input terminal is connected to an output of the inverter 102. In the second embodiment, the antenna circuit 42 further comprises a mixer 60 in which one input terminal is connected to an output of the adder 104 and the other input terminal is connected to an output of the radio-frequency signal generator S1.

Also in the antenna circuit 42 of the second embodiment, since an inversion signal of the signal of radio-frequency signal generator S1 is added, carrier signal level of the modulated signal reduces. Here, when there is a possibility of the carrier signal level being not more than twice as much as side bands level in the adder 104, the mixer 60 can be installed instead of the envelope detector circuit. In this case, synchronous detection is performed by multiplexing the modulated signal and inversion signal.

In the present invention, a radio-frequency signal output from the radio-frequency signal generator S1 is the carrier signal. Therefore, synchronous detection is performed only by adding the signal from the radio-frequency signal generator as it is (at the same phase). Similar to the first embodiment, since the carrier signal level is reduced, the noise component also can be reduced. Thus, it becomes easy to detect the side bands.

According to the second embodiment, the modulated signal can be detected to extract side bands regardless of reduction level of the carrier signal. Thus it becomes possible to improve sensitivity of the antenna circuit.

THIRD EMBODIMENT

Figure 8:
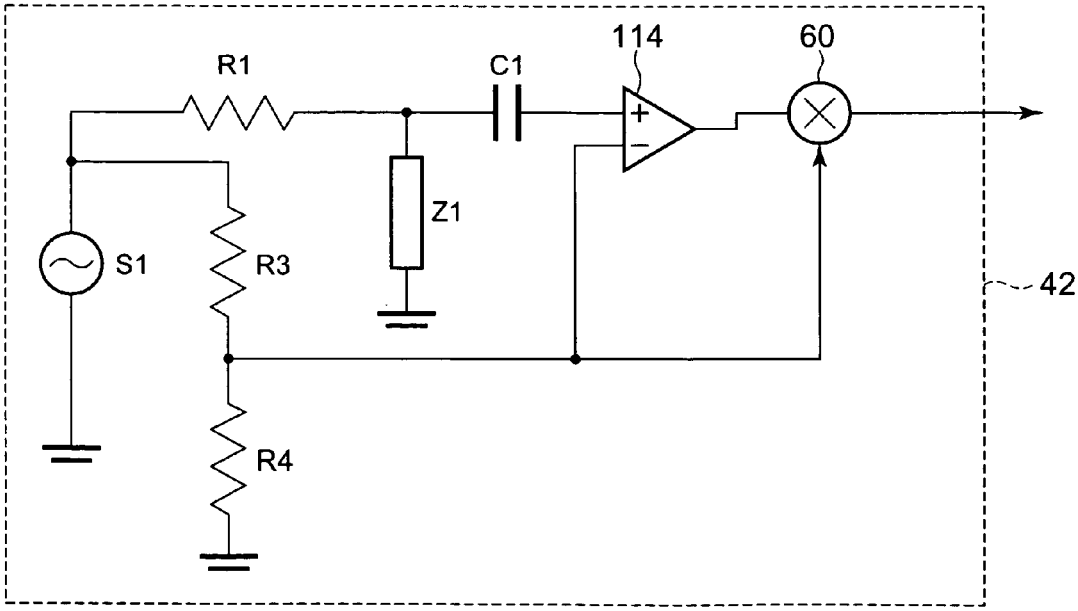
FIG. 8 shows an antenna circuit of a third embodiment.

In the first and second embodiments, an inversion signal of a carrier signal is added to cancel the carrier signal. In the third embodiment, a differential amplifier is utilized to cancel the carrier signal. FIG. 8 shows an antenna circuit of the third embodiment.

The antenna circuit 42 of the third embodiment comprises a radio-frequency signal generator S1, a resistance R1, a condenser C1 and an MI magnetic sensor Z1. In the third embodiment, a signal line wired from the radio-frequency signal generator S1 is connected to a resistance R3. The resistance R3 is connected to a resistance R4.

A signal line wired from the condenser C1 is connected to a plus input terminal of a differential amplifier 114, and a signal line wired from midway of the resistance R3 and R4 is connected to a minus input terminal of the differential amplifier 114. A signal line from output of the differential amplifier 114 is connected to one input terminal of a mixer 60. The signal line wired from midway of the resistance R3 and R4 is also connected to the other input terminal of the mixer 60.

In the present embodiment, it is preferable that the impedance of each element is configured to be R1=R3=R4=Z1. However, the impedance is not limited thereto. When the impedance is configured so, a level-adjusted radio-frequency signal input to the minus input terminal of the differential amplifier 114 cancels a carrier component of the modulated signal input to the plus input terminal of the differential amplifier 114. That is, in the absence of magnetic field, the signal input to the minus input terminal of the differential amplifier 114 approximately cancels the signal input to the plus input terminal of the differential amplifier 114. Thus, the signal output from the differential amplifier 114 is overmodulated. However, it is possible to extract side bands by employing synchronous detection.

According to the third embodiment, the carrier component of the modulated signal is removed with the differential amplifier, and the modulated signal in which appreciable part of the carrier component has been removed is subject to synchronous detection, so as to extract side bands. As a result, it becomes possible to improve sensitivity of the antenna circuit.

FOURTH EMBODIMENT

Figure 9:
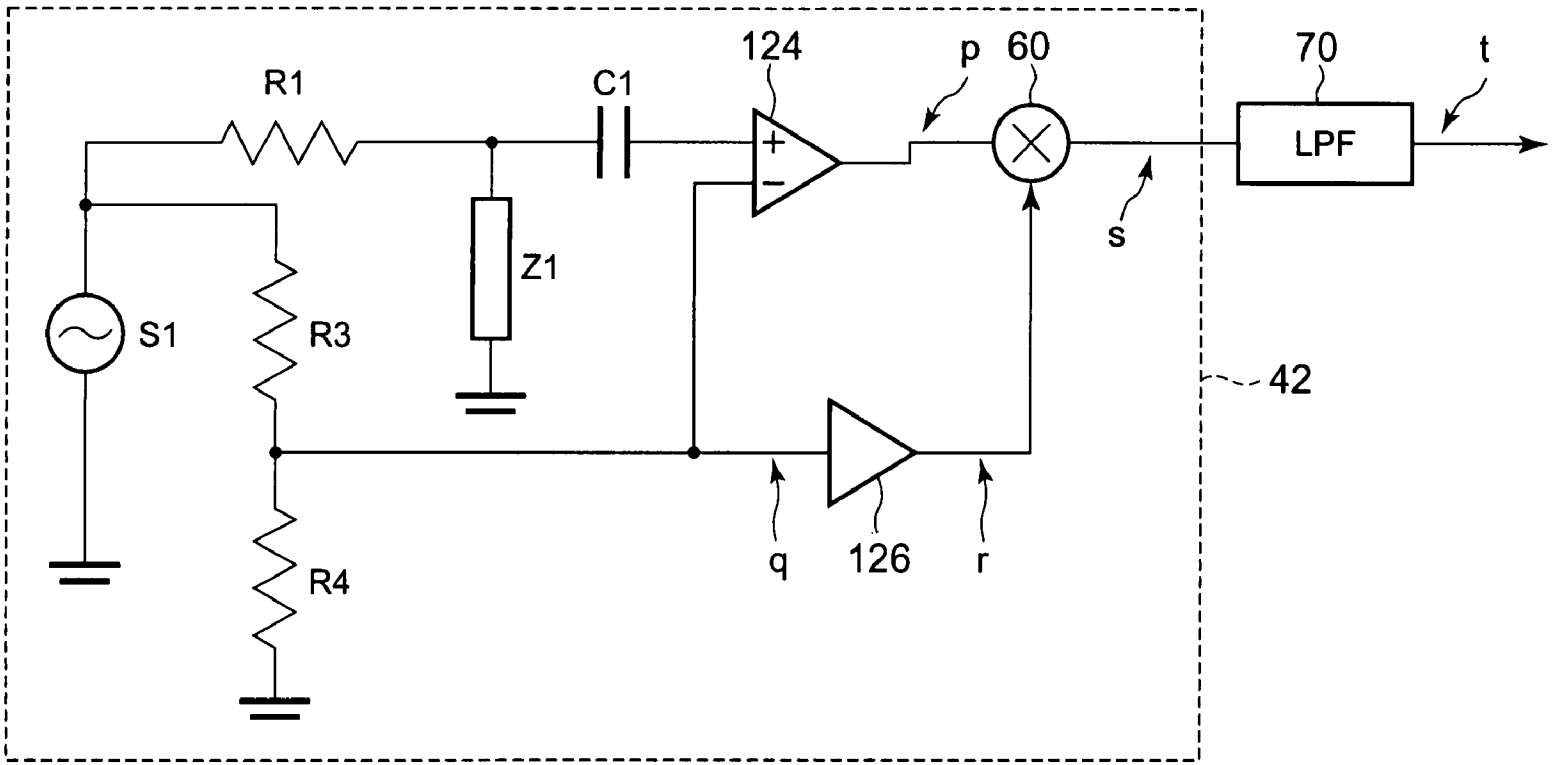
FIG. 9 shows an antenna circuit and a LPF following after the antenna circuit of a fourth embodiment.

As shown in FIG. 9, in the fourth embodiment, a pulse signal (rectangular wave) is applied through a comparator 126, instead of applying the signal at the midway of the resistance R3 and R4 to the mixer 60 as shown in the antenna circuit of the third embodiment. Similar to the third embodiment, it is preferable that the impedance of each element is R1=R3=R4=Z1 in the antenna circuit of the fourth embodiment. By configuring so, a radio-frequency signal input to a minus input terminal of a differential amplifier 124 cancels a carrier component of the modulated signal input to a plus input terminal of the differential amplifier 124.

Figure 10:
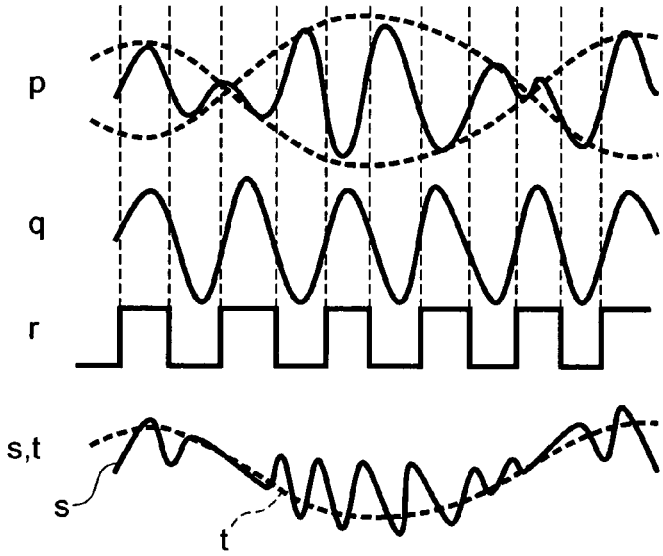
FIG. 10 shows signals at points p, q, r, s and t in FIG. 9.

FIG. 10 shows signals of points p, q, r, s and t of FIG. 9. As shown in FIG. 10, the signal at point p corresponding to output of the differential amplifier 124 is overmodulated. When it is assumed the radio-frequency signal generator S1 generates a signal represented by A sin ωt, a signal represented by (A/2)sin ωt at point q is input to the comparator 126. Accordingly, at point r, a pulse signal (rectangular wave) synchronizing to the signal at point q is output. The signal which has been subject to synchronous detection by the mixer 60 (see point s) is filtered through a LPF 70, so that a signal showing magnetic field change (see point t) can be obtained.

In the fourth embodiment, the comparator 126 converts the signal to be input to the mixer 60 to a pulse. By doing so, the antenna circuit 42 can be constructed with an IC such as C-MOS. Further, since the comparator 126 converts the radio-frequency signal to a pulse, it becomes possible to reduce power consumption of the antenna circuit 42.

FIFTH EMBODIMENT

Next, a fifth embodiment of the present invention is described. In the first to fourth embodiments, a carrier signal of the modulated signal is cancelled for enabling to extract the side bands appropriately, in order to improve sensitivity of the antenna circuit. In the fifth embodiment, an antenna circuit which can reduce thermal noise is provided.

Figure 11:
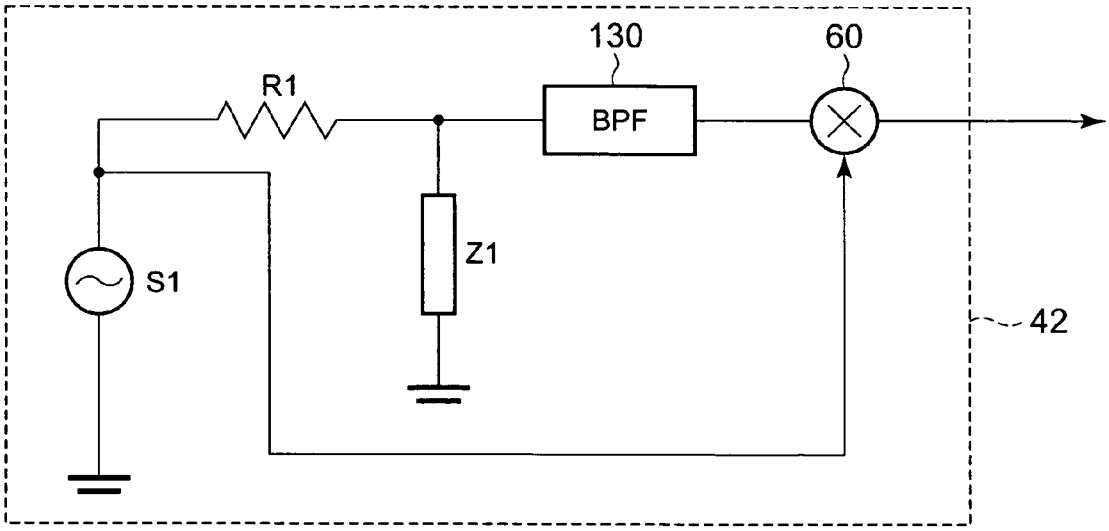
FIG. 11 shows an antenna circuit of a fifth embodiment.

FIG. 11 shows the antenna circuit of the fifth embodiment. As shown in FIG. 11, the antenna circuit 24 of the fifth embodiment comprises a radio-frequency signal generator S1, a resistance R1, a condenser C1, an MI magnetic sensor Z1 and a mixer 60. A radio-frequency signal from the radio-frequency signal generator S1 as well as the modulated signal is applied to the mixer 60.

Figure 20A:
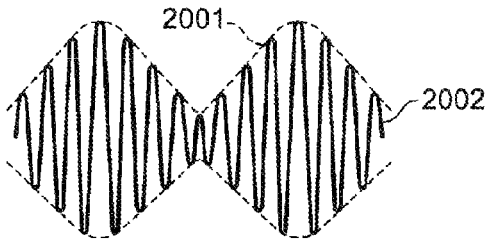
FIG. 20A PRIOR ART
FIG. 20A shows an example of radio-frequency signal modulated by magnetic field change.
Figure 20B:
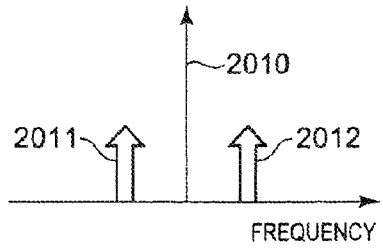
FIG. 20B PRIOR ART
FIG. 20B is a view to explain the modulated frequency component.
Figure 21:
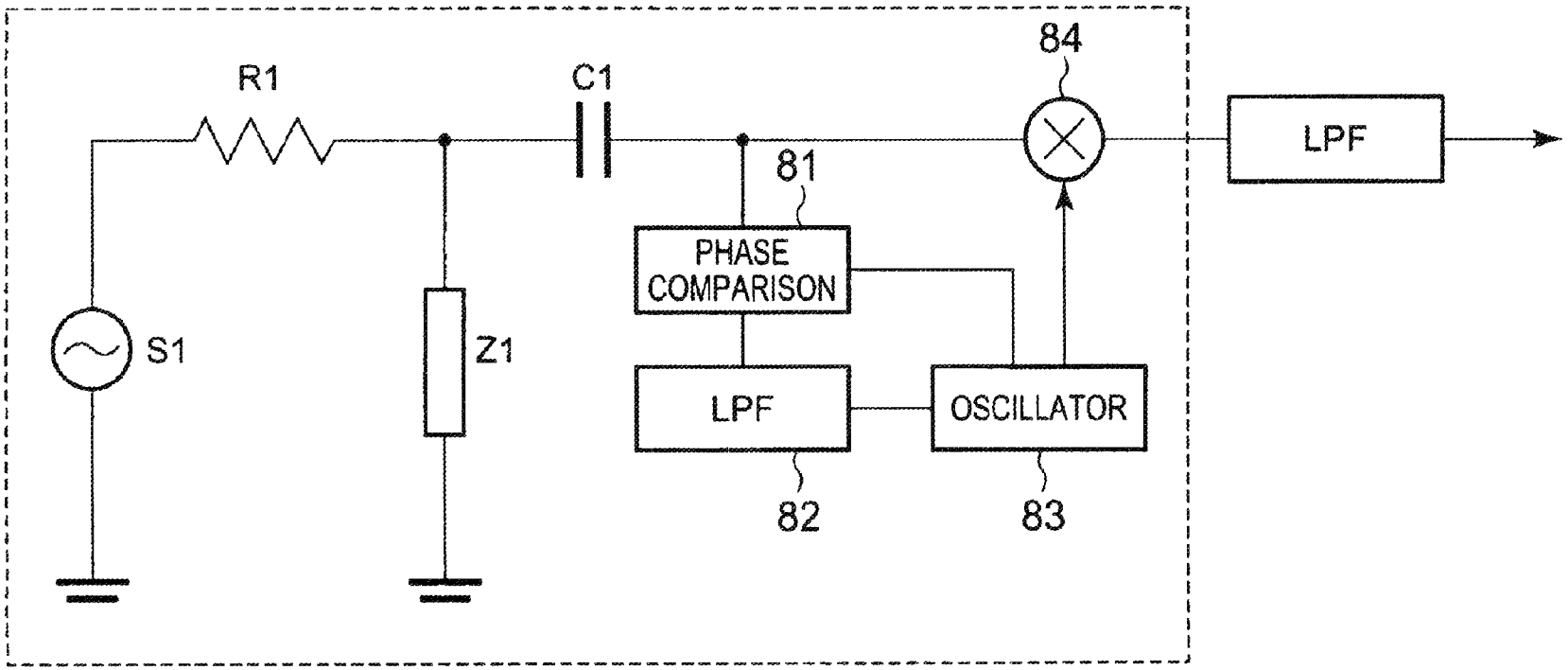
FIG. 21 PRIOR ART
FIG. 21 shows an antenna circuit and a filter circuit following after the antenna circuit of earlier development.

Synchronous detection of the earlier development requires an LPF 82, a local oscillator 83 and a phase comparator 84 as shown in FIG. 20, in order to apply a signal having same phase as that of a carrier signal of a modulated signal. On the other hand, it is desirable for the antenna circuit 42 of the present embodiment that the radio-frequency signal generator S1 generates a radio-frequency signal and the radio-frequency signal is removed from the modulated signal as a carrier signal. Since the signal from the radio-frequency signal generator S1 is applied to the mixer 60, it becomes possible to perform stable and precise synchronous detection without phase synchronization.

Further, the present invention is successful in removing a defect of a circuit of earlier development regarding synchronous detection in weak magnetic field. Thus, it becomes possible to improve sensitivity of the antenna circuit.

SIXTH EMBODIMENT

Figure 12:
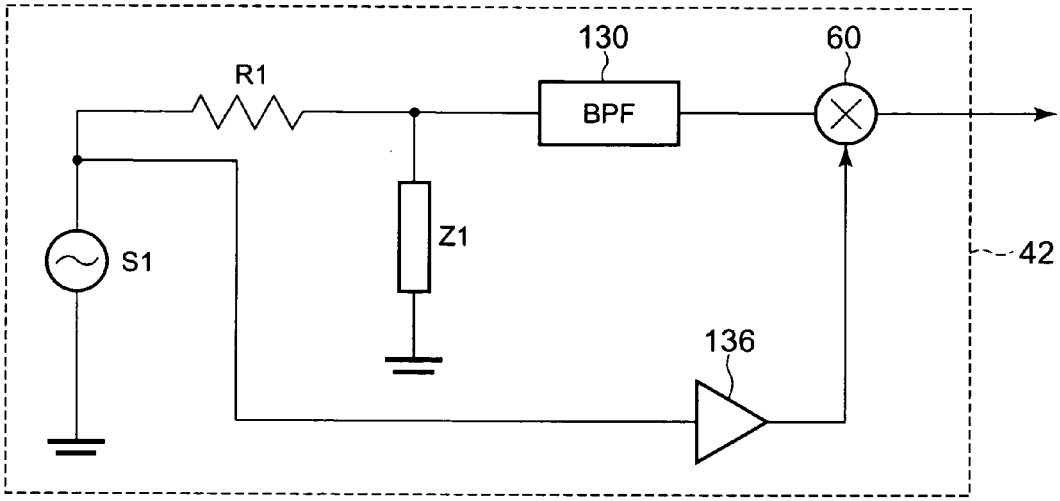
FIG. 12 shows an antenna circuit of a sixth embodiment.

FIG. 12 shows an antenna circuit of the sixth embodiment. As shown in FIG. 12, the sixth embodiment is configured so that a pulse signal (rectangular wave) is applied through a comparator 136, instead of applying the signal of the radio-frequency signal generator S1 to the mixer 60 as shown in the antenna circuit of the fifth embodiment. The relation of the sixth embodiment to the fifth embodiment approximately corresponds to the relation of the fourth embodiment to the third embodiment.

Operation of an antenna circuit 42 of the sixth embodiment is as same as that of the fifth embodiment. In the sixth embodiment, a comparator 136 converts a signal to be input to the mixer 60 to a pulse. By doing so, the antenna circuit 42 can be constructed with an IC such as C-MOS. Further, the comparator 136 converts the radio-frequency signal to a pulse. Thus, it becomes possible to reduce power consumption of the antenna circuit 42.

SEVENTH EMBODIMENT

Figure 13:
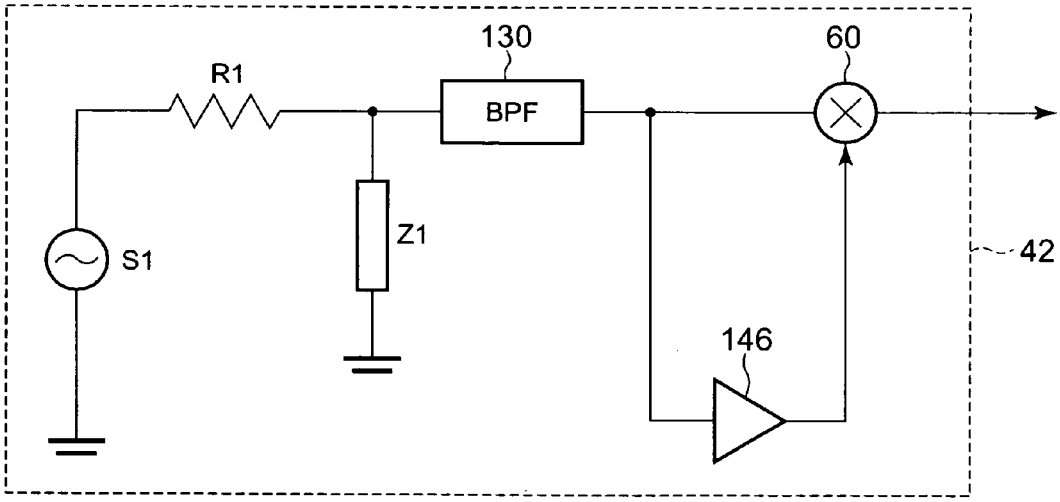
FIG. 13 shows an antenna circuit of a seventh embodiment.

FIG. 13 shows an antenna circuit of a seventh embodiment. As shown in FIG. 13, output of a condenser C1, i.e. the modulated signal, is input to a comparator 146 and output of the comparator 146 is applied to a mixer 60, so as to perform synchronous detection, instead of inputting the signal of the radio-frequency signal generator S1 to the comparator and applying the pulse signal (rectangular signal) having the same cycle as the radio-frequency signal to the mixer 60. That is, a pulse signal (rectangular wave) having the same cycle and phase as the radio-frequency signal is generated according to the modulated signal, and applies it to the mixer 60, so as to obtain similar effect to that of the fifth and sixth embodiment, instead of applying the radio-frequency signal (or corresponding rectangular wave) to the mixer as it is and multiplying. The present embodiment is particularly effective when the modulated signal is sufficiently high.

EIGHTH EMBODIMENT

Figure 14:
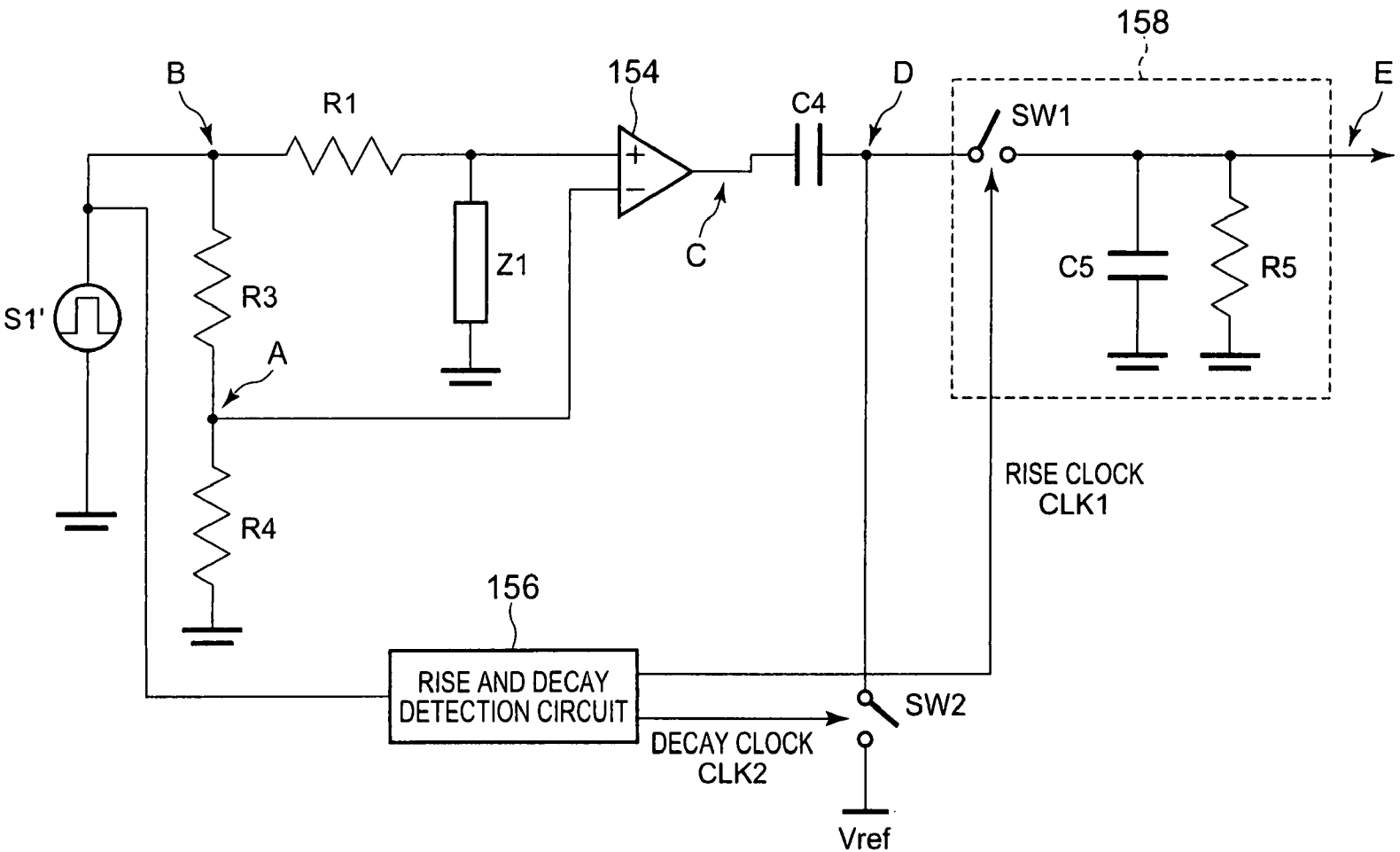
FIG. 14 shows an antenna circuit of a eighth embodiment.

Next, an eighth embodiment of the present invention is described. FIG. 14 shows an antenna circuit of the eighth embodiment. As shown in FIG. 14, an antenna circuit 42 of the eighth embodiment comprises a radio-frequency signal generator S1', resistances R1, R3 and R4, an MI magnetic sensor Z1, a condenser C4, a differential amplifier 154, a rise and decay detection circuit 156, a sample-hold circuit 158 comprising a switch SW1, a condenser C5 and a resistance R5, and a switch SW2.

In the eighth embodiment, the differential amplifier 154 is utilized similar to the third embodiment. A radio-frequency signal of the radio-frequency signal generator S1' is adjusted in level at the resistance R3 and R4 and is applied to a minus input terminal of the differential amplifier 154, while the modulated signal is applied to a plus input terminal of the differential amplifier 154. It is preferable that the impedance of each element is configured to be R1=R3=R4=Z1. However the impedance is not limited thereto. By configuring so, the level-adjusted radio-frequency signal input to a minus input terminal of the differential amplifier 154 cancels a carrier component of the modulated signal input to the plus input terminal of the differential amplifier 154.

In the eighth embodiment, the radio-frequency signal generator S1' does not output sin wave but rectangular wave. The rectangular wave includes a lot of high frequency component compared with sin wave of the same wavelength. Accordingly, it is advantageous because it easily causes skin effect of the MI magnetic sensor Z1.

Figure 15:
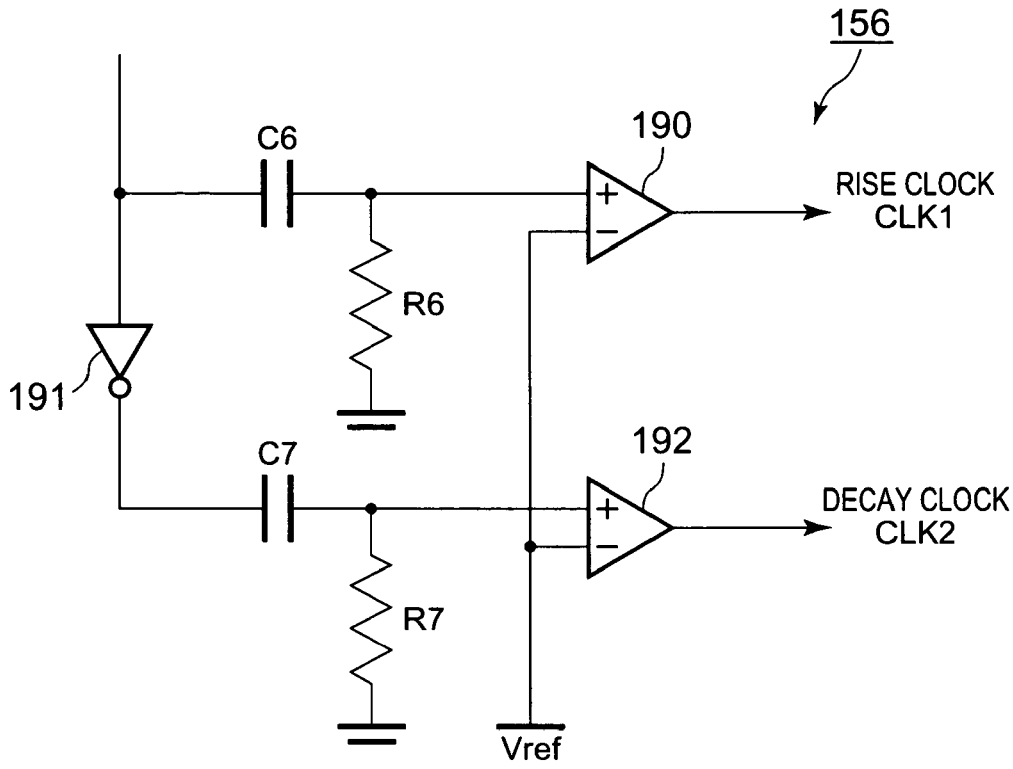
FIG. 15 shows a configuration of a rise and decay detection circuit.

The rise and decay detection circuit 156 detects both rise and decay of the rectangular wave of the radio-frequency signal generator S1', and outputs a rise clock CLK1 which is a pulse output at the time of rise and a decay clock CLK2 which is a pulse output at the time of decay. FIG. 15 shows configuration of the rise and decay detection circuit 156.

As shown in FIG. 15, the rise and decay detection circuit 156 comprises a condenser C6, a resistance R6, a comparator 190, an inverter 191, a condenser C7, a resistance R7 and a comparator 192. The condenser C6 and resistance R6 constitute a differential circuit, and the output thereof is applied to a plus input terminal of the comparator 190. Reference voltage Vref is applied to a minus input terminal of the comparator 190. The condenser C7 and resistance R7 constitute another differential circuit. Rectangular wave inverted by the inverter 191 is applied to the differential circuit. Output of the differential circuit is applied to a plus input terminal of the comparator 192. Reference voltage Vref is also applied to a minus input terminal of the comparator 192.

The rise clock CLK1 controls the switch SW1 of the sample-hold circuit 158. When the rise clock CLK1 is at high level, the switch SW1 is closed and a signal from the condenser C4 is lead to the sample-hold circuit 158. The decay clock CLK2 controls the switch SW2. When the decay clock CLK2 is at high level, the switch SW2 is closed and reference voltage Vref charges the condenser C4.

Figure 16:
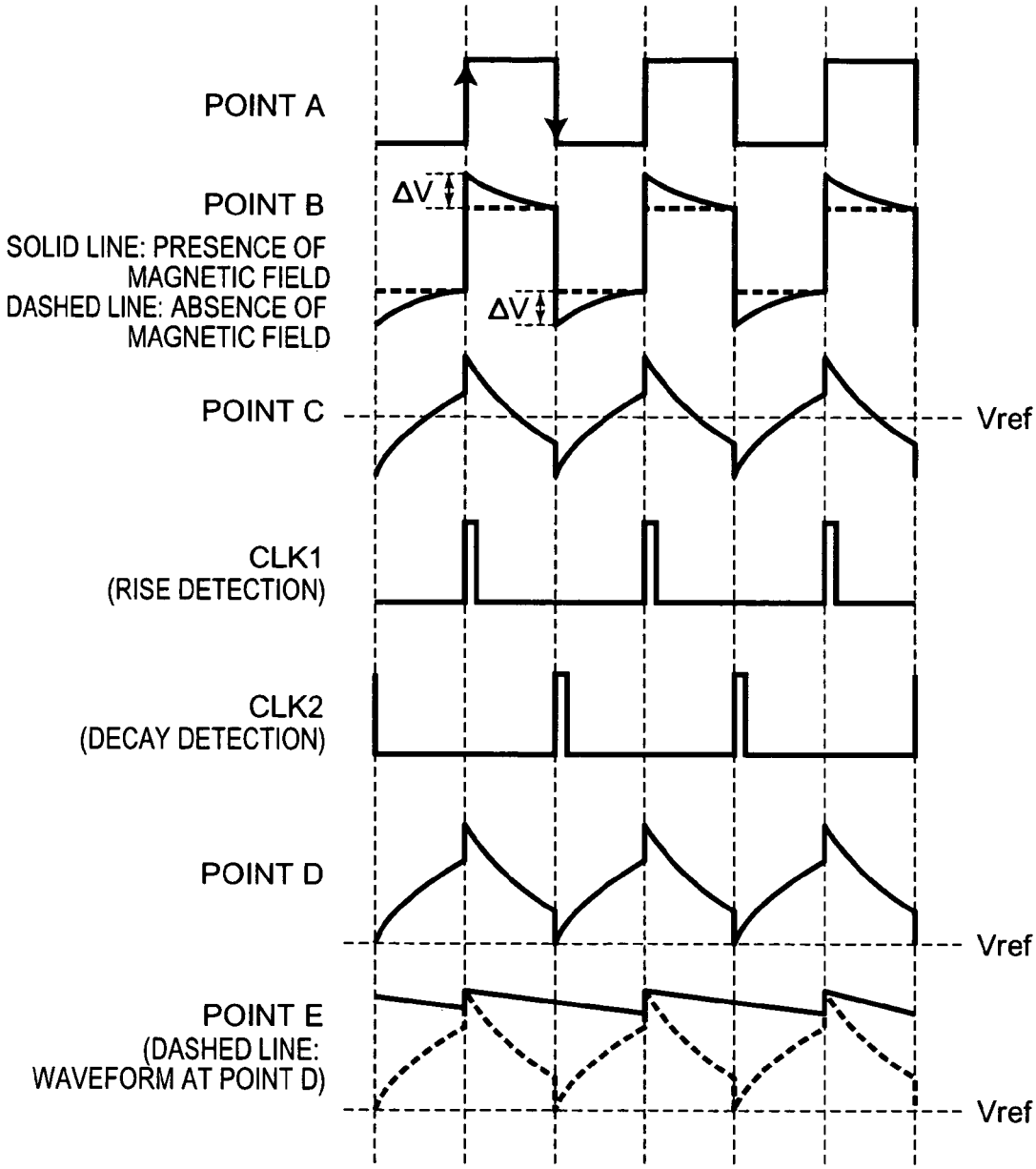
FIG. 16 shows a signal at each point of the antenna circuit of the eighth embodiment.
Figure 17:
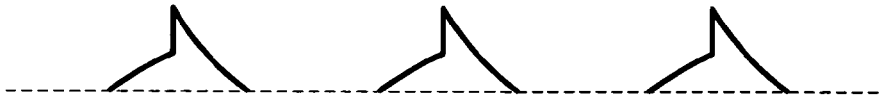
FIG. 17 shows an example of a signal in an antenna circuit of earlier development.

Hereinafter, operation of the eighth embodiment is described in more detail with reference to FIG. 16 which shows waveform at each point of the antenna circuit shown in FIG. 14. As shown in FIG. 16, a level-adjusted wave of the rectangular wave of the radio-frequency signal generator S1' is observed at point A located between the resistance R3 and R4. At point B, similar waveform to that at point A shown as a dashed line is observed in the absence of magnetic field. When the MI magnetic sensor detects magnetic field, the waveform is changed to a form shown as a solid line. The differential amplifier 154 can retrieve the changed portion according to the detection of magnetic field at point B (see point C of FIG. 16). Since the MI magnetic sensor drives by using high-frequency component at rise and decay of the radio-frequency signal, change at the edge portions is particularly remarkable.

At the timing when the CLK2 of rise detection becomes at high level, output of the differential amplifier 154 (see point C) is charged in the condenser C2, and the signal having its center at Vref is clamped to be Vref reference, i.e. clamped so that the lowest level is Vref. By this clamp, both changes at rise and decay edges of output of the differential amplifier 154 can be retrieved. For example, when the output of the differential amplifier 154 is only half-wave (or full-wave) rectified and integrated, only the changed portion at the rising portion is retrieved. Thus, output level of the detected signal lowers and detection sensitivity decreases. On the other hand, according to the present embodiment, both changed portions at rise and decay can be retrieved. Thus, output level of the detected signal becomes high.

When the rise clock CLK1 controls the switch SW1, the sample-hold circuit 158 detects a peak value of the clamped waveform. Thus, detection is performed. The detected output is represented as a waveform at point E.

According to the eighth embodiment, decay of the radio-frequency signal output from the radio-frequency signal generator is detected. At the detected timing, output of the differential amplifier, i.e. changed portion according to detected magnetic field change, is clamped. Accordingly, it becomes possible to increase output level of the detection.

NINTH EMBODIMENT

[Internal Configuration]

Figure 22:
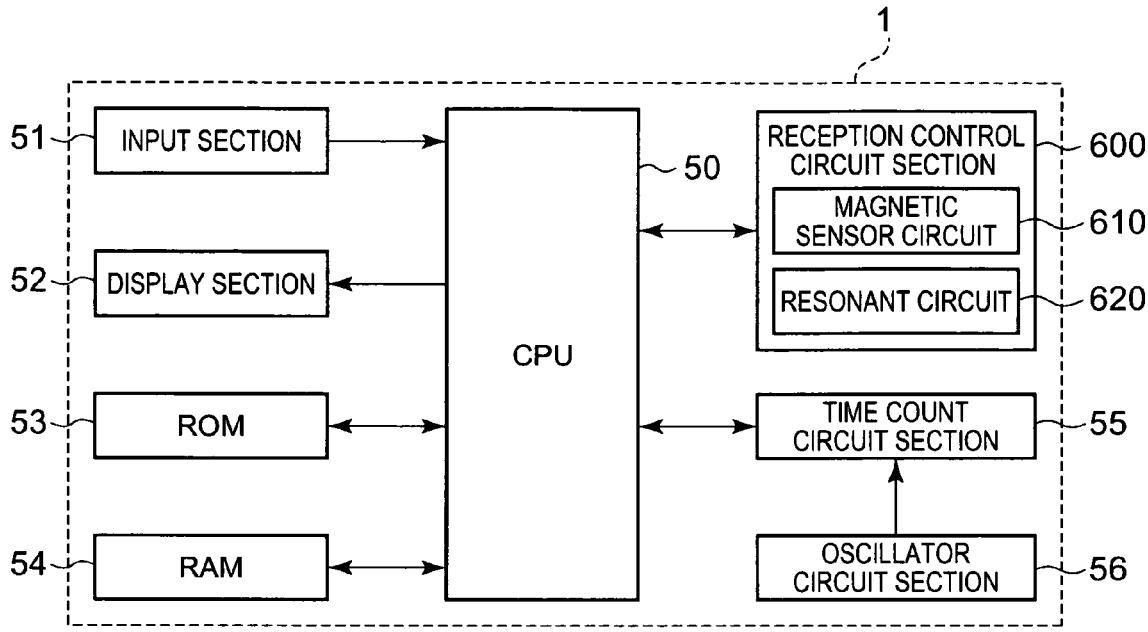
FIG. 22 is an internal block diagram of a wrist watch.

FIG. 22 is a block diagram showing internal configuration of the wrist watch 1. The element having the same configuration as that in FIG. 3 is represented by the same reference numeral, and the explanation thereof is omitted.

The reception control circuit section 600 includes a magnetic sensor circuit 610 and a resonant circuit 620, retrieves a signal of predetermined frequency by cutting off the unnecessary frequency component of the received signal, converts the frequency signal to a corresponding electric signal, and outputs it to a CPU 50.

Figure 23:
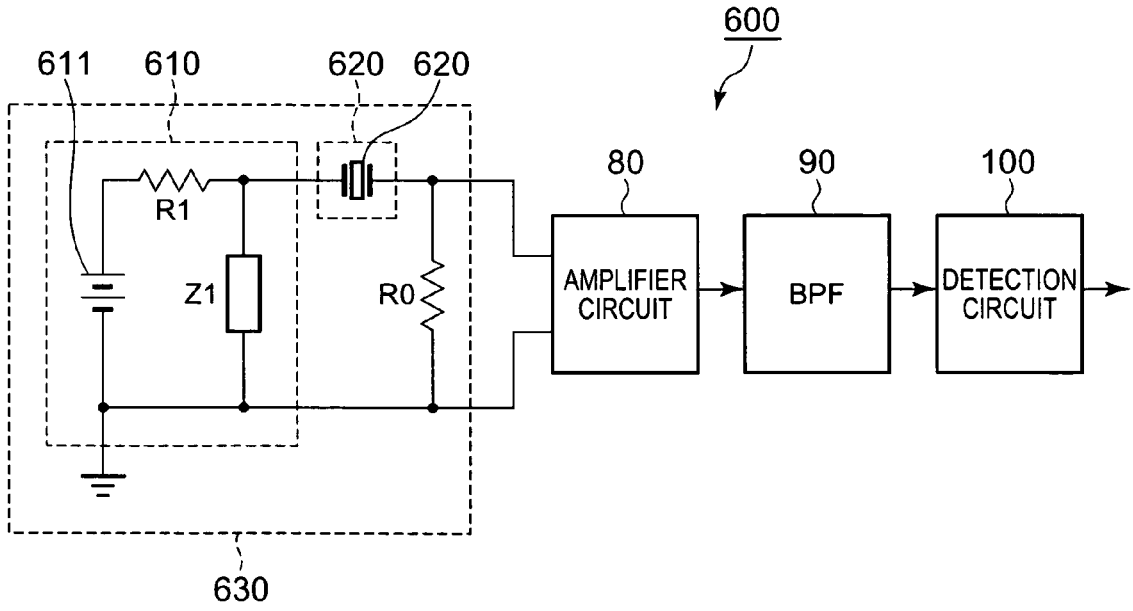
FIG. 23 shows an example of circuit configuration of a reception control circuit section.

FIG. 23 shows circuit configuration of the reception control circuit section 600. In FIG. 23, the reception control circuit section 600 comprises a magnetic sensor circuit 610, a resonant circuit 620, a resistance R0, a amplifier circuit 80, a filter circuit 90 and a detector circuit 100. The magnetic sensor circuit 610, resonant circuit 620 and resistance R0 constitute an antenna apparatus 630.

The magnetic sensor circuit 610 is a magnetic sensor utilizing magnetoresistance effect, and comprises a DC power source 611, a resistance R1 and a magnetoresistance element Z1.

In the magnetic sensor circuit 610, magnetic field change becomes detectable when the DC power source 611 applies DC voltage to the magnetoresistance element Z1. That is, when external magnetic field changes, magnetoresistance of the magnetoresistance element Z1 changes. Accordingly, a voltage across the magnetoresistance element 612 changes. This change in voltage across the magnetoresistance element Z1 is a signal of magnetic field change detected by the magnetic sensor circuit 610.

The resonant circuit 620 comprises a resonant element 621 made of quartz (crystal), and installed at the later stage of the magnetic sensor circuit 610. The resonant element is not limited to quartz, and can be made of ceramic. According to resonance effect of the resonant circuit 620, intended magnetic field change according to standard frequency broadcast is retrieved from the magnetic field change detected by the magnetic sensor circuit 610.

That is, at a resonance point, since impedance of the resonant circuit 620 is sufficiently low, a voltage according to output voltage of the magnetic sensor circuit 610 and the resistance R0 is output as a received signal of the antenna apparatus 630. Out of the resonance point, impedance of the resonant circuit 620 increases drastically. Thus, output signal of the antenna apparatus 630 becomes extremely low. As a result, magnetic field change only at resonant frequency of the resonant circuit 620 is output as the received signal of the antenna apparatus 630.

Figure 24A:
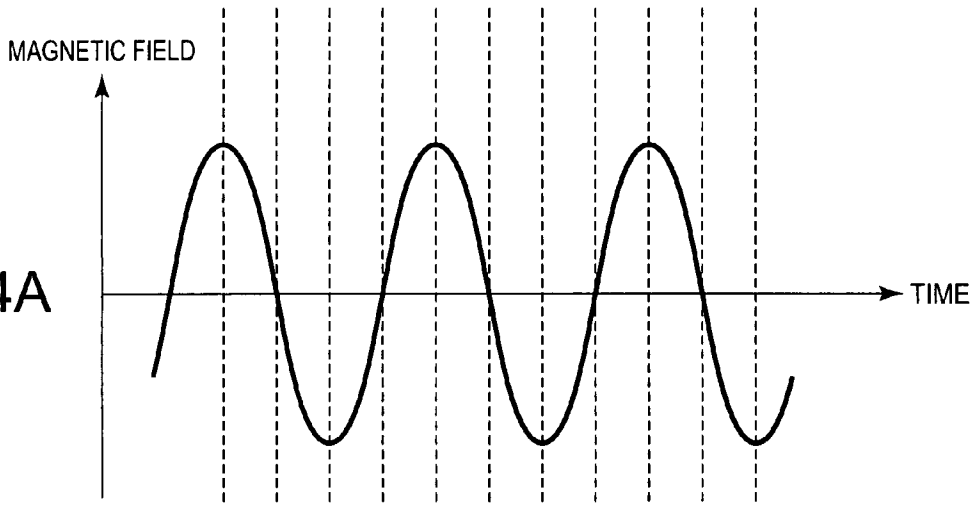
FIGS. 24A and 24B show an example of correlation between external magnetic field and impedance change of a magnetoresistance element caused by the external magnetic field.
Figure 24B:
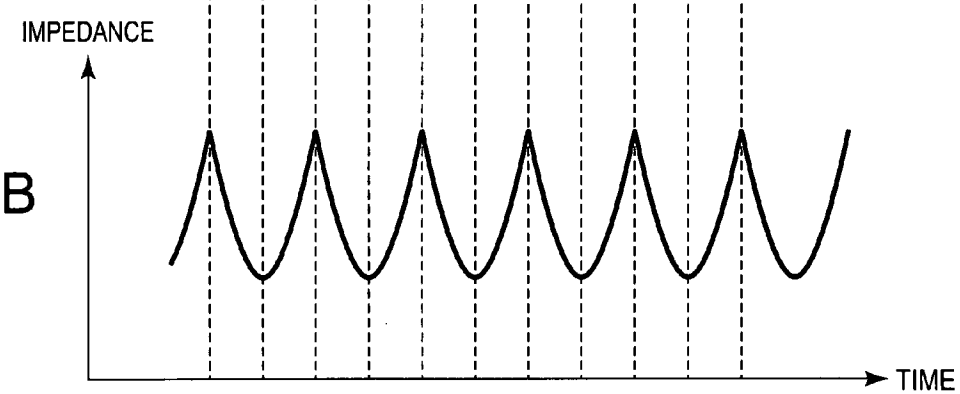

The resonant frequency of the resonant circuit 620 is configured to be twice as much as carrier frequency of the intended standard frequency broadcast. The reason is as follows. Magnetic field caused by standard frequency broadcast which is AC electric wave changes its direction and intensity periodically according to time as shown in the graph of FIG. 24A. The impedance of the magnetoresistance element Z1 changes as shown in FIG. 24B according to the magnetic field shown in FIG. 24A. That is, impedance of the magnetoresistance element 612 changes only according to intensity of magnetic field regardless of direction of the magnetic field. Thus, the impedance folds back at the magnetic field of 0, and changes ½ cycle of that of standard frequency broadcast. Accordingly, the antenna apparatus 630 receives only the standard frequency broadcast by setting the resonant frequency of the resonant circuit 620 to be twice as much as the carrier frequency of the intended standard frequency broadcast.

The amplifier circuit 80 amplifies and outputs a signal input from the antenna apparatus 630. The filter circuit 90 passes through a signal within a predetermined frequency range and cuts off the frequency component without the range, among the signal input from the amplifier 80. The detector circuit 100 detects and outputs a signal input from the filter circuit 650. The detected signal output from the detector circuit 100 is input to the CPU 50, and is utilized to correct the current time and the like.

According to the present embodiment, the antenna apparatus 630 can be downsized by employing the magnetic sensor 610 utilizing a magnetoresistance effect and the resonant circuit 620. Further, since the magnetoresistance element 612 is an antenna to receive standard frequency broadcast, dimagnetic field does not occur very much different from a conventional bar antenna. Thus, deterioration of receiving sensitivity is small.

[Modification]

The present invention is not limited to the above-described embodiments, and can be modified within the sprit of the present invention.

(A) Resonant Circuit

Figure 25:
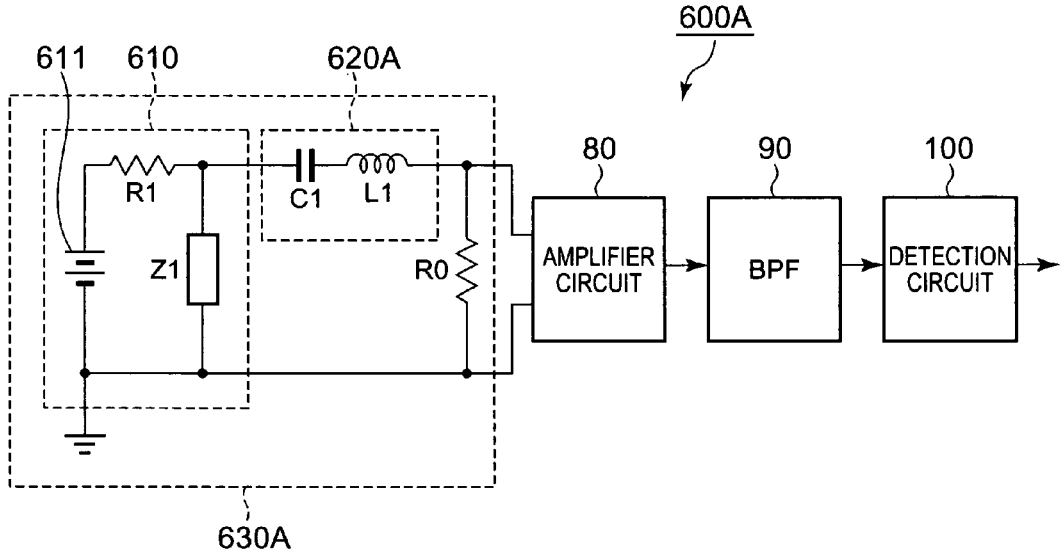
FIG. 25 is an example of circuit configuration of a reception control circuit section in which a LC resonant circuit is employed.

In the above-described embodiments, the resonant circuit 620 is composed of a resonant element 621 made of quartz or the like. However, the resonant circuit 620 also may be a LC resonant circuit. FIG. 25 shows circuit configuration of the reception control circuit 600A to which a LC resonant circuit is employed. In FIG. 25, an element as same as that of the reception control circuit section 600 is represent by the same reference numeral. As shown in FIG. 23, the reception control circuit section 600A comprises a magnetic sensor circuit 610, a resonant circuit 620A, a resistance R0, a amplifier circuit 80, a filter circuit 90 and a detector circuit 100. The magnetic sensor circuit 610, resonant circuit 620A and resistance R0 constitute an antenna apparatus 630A.

The resonant circuit 620A is a LC resonant circuit comprising a condenser C1 and an inductor L1 connected in series. The resonant frequency of the resonant circuit 620A is set to be twice as much as the carrier frequency of the intended standard frequency broadcast.

Figure 26:
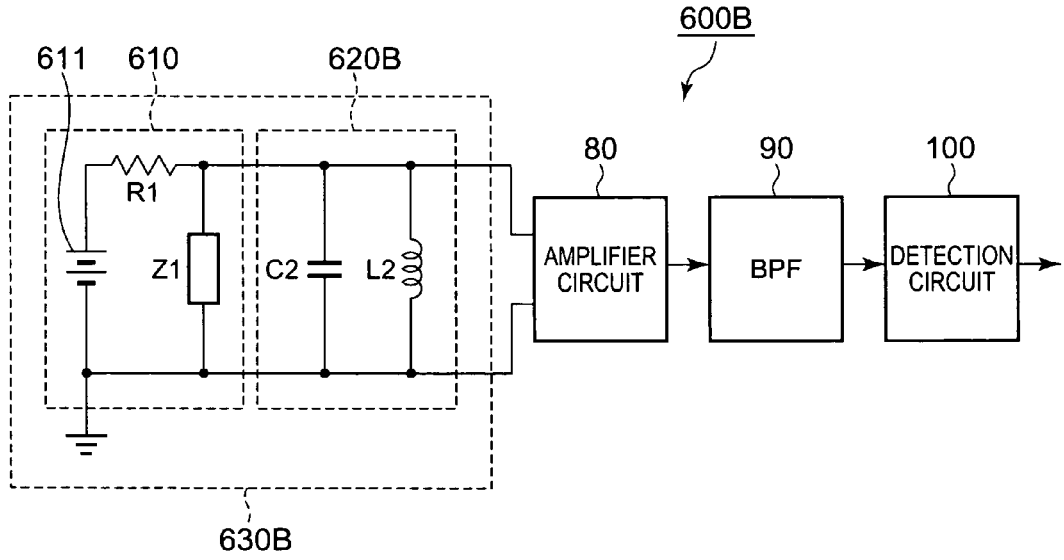
FIG. 26 is an example of circuit configuration of a reception control circuit section in which an antiresonant circuit is employed.

An antiresonant circuit (parallel resonant circuit) can be used instead of the resonant circuit. FIG. 26 shows circuit configuration of a reception control circuit section 600B using an antiresonant circuit. As shown in FIG. 26, the reception control circuit section 600B comprises a magnetic sensor circuit 610, an antiresonant circuit 620B, an amplifier circuit 80, a filter circuit 90 and a detection circuit 100. The magnetic sensor 610 and antiresonant circuit 620B constitute an antenna apparatus 630B.

The antiresonant circuit 620B is an LC resonant circuit comprising a condenser C2 and an inductor L2 connected in parallel, and is connected with the magnetic sensor circuit 610 in parallel. The antiresonant circuit 620B may comprise a predetermined antiresonant element instead of the LC antiresonant circuit.

The impedance of the antiresonant circuit 620B is sufficiently high at a resonance point, and then an output signal of the magnetic sensor 610 is output as the received signal of the antenna apparatus 630B. Out of the resonance point, since the impedance of the antiresonant circuit 620B drastically decreases, the output signal of the antenna apparatus 630B becomes extremely low. Further, the resonant frequency of the antiresonant circuit 620B is set to be twice as much as carrier frequency of the intended standard frequency broadcast, since the magnetoresistance value of the magnetoresistance element Z1 changes only in accordance with intensity of magnetic field. As a result, it becomes possible to allow the antenna apparatus 630B to receive only the standard frequency broadcast.

Figure 27:
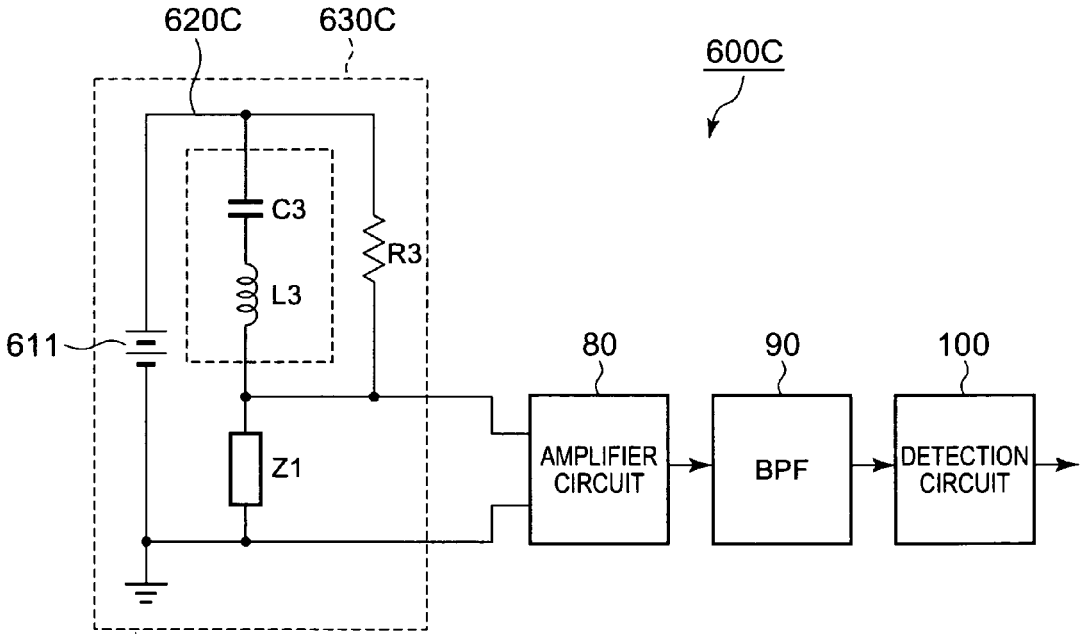
FIG. 27 is an example of circuit configuration of a reception control circuit section in which a magnetic sensor and a resonant circuit are connected in series.

The magnetic sensor and resonant circuit may be connected in series. FIG. 27 shows a circuit configuration of a reception control circuit section 600C in which a magnetic sensor and resonant circuit are connected in series. As shown in FIG. 27, the reception control circuit section 600C comprises a DC power source 611, a magnetoresistance element Z1, a resonant circuit 620C, a resistance R3, an amplifier circuit 80, a filter circuit 90 and a detection circuit 100. The DC power source 611, magnetoresistance element Z1, resonant circuit 620C and resistance R3 constitute an antenna apparatus 630C.

The resonant circuit 620C is an LC resonant circuit comprising a condenser C3 and an inductor L3 connected in series. The resonant circuit 620C and magnetoresistance element Z1 are connected in series, and the resonant circuit 620C and resistance R3 are connected in parallel. The DC power source 611 applies a constant voltage across the resonant circuit 620C and magnetoresistance element connected in series, and the voltage across the magnetoresistance element Z1 is output as the received signal of the antenna apparatus 630.

The impedance of the resonant circuit 620C is sufficiently low at a resonance point, and then a voltage corresponding to a ratio between the resistance R0 and magnetoresistance element Z1 is output as the received signal of the antenna apparatus 630C. Out of the resonance point, since the impedance of the resonant circuit 620C is sufficiently high, the output signal of the antenna apparatus 630C is extremely low. Further, the resonant frequency of the antiresonant circuit 620C is set to be twice as much as the carrier frequency of the intended standard frequency broadcast, since the magnetoresistance value of the magnetoresistance element Z1 changes only in accordance with intensity of magnetic field as described above. As a result, it becomes possible to allow the antenna apparatus 630C to receive only the standard frequency broadcast.

(B) Selection of Receiving Frequency

In the above-described embodiments, the standard frequency broadcast of predetermined frequency is received. However, a plurality of standard frequency broadcasts of different carrier frequencies may be received. Concretely, it realizes by switching resonant frequency of the resonant circuit.

Figure 28:
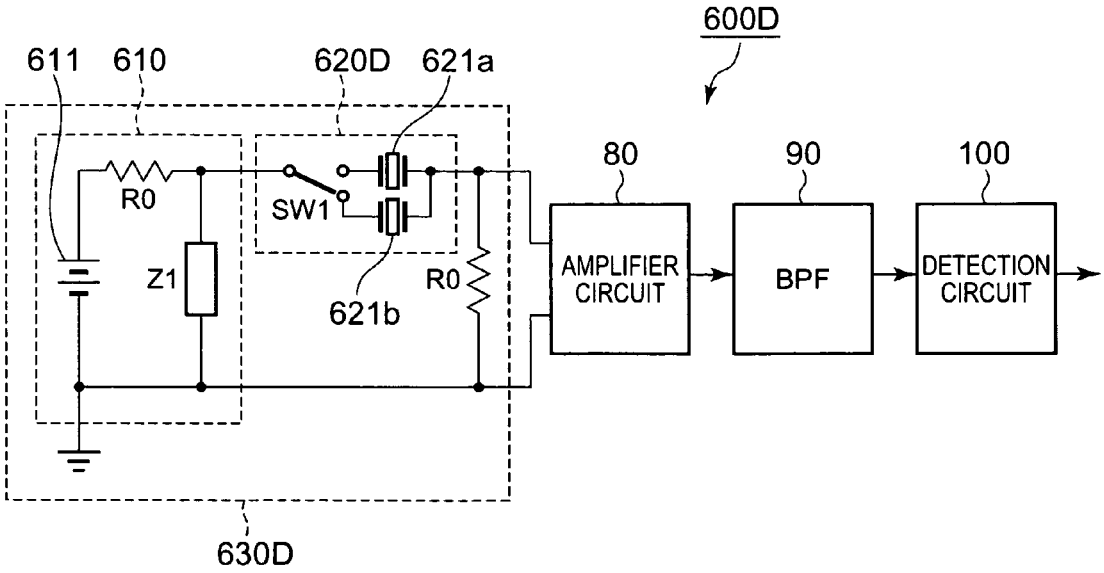
FIG. 28 is an example of circuit configuration of a reception control circuit section in which a receiving frequency is switchable.

For example, FIG. 28 is one example of a circuit configuration of a reception control circuit section 600D in which the modification is applied to the reception control circuit section 600 shown in FIG. 23. As shown in FIG. 28, the reception control circuit section 600D has a configuration that the resonant circuit 620 of the reception control circuit 600 is replaced with a resonant circuit 620D.

The resonant circuit 620D has a configuration that two oscillation elements 621*a* and 621*b* connected in parallel are connected with a switch SW1 in series. The oscillation elements 621*a* and 621*b* have different oscillation frequencies from each other. The switch SW1 switches a connection to connect one of the oscillation elements 621*a* and 621*b*, so as to switch the resonant frequency of the resonant circuit 620D. Thus, the reception control circuit section 600D can receive two standard frequency broadcasts of different frequencies.

Figure 29:
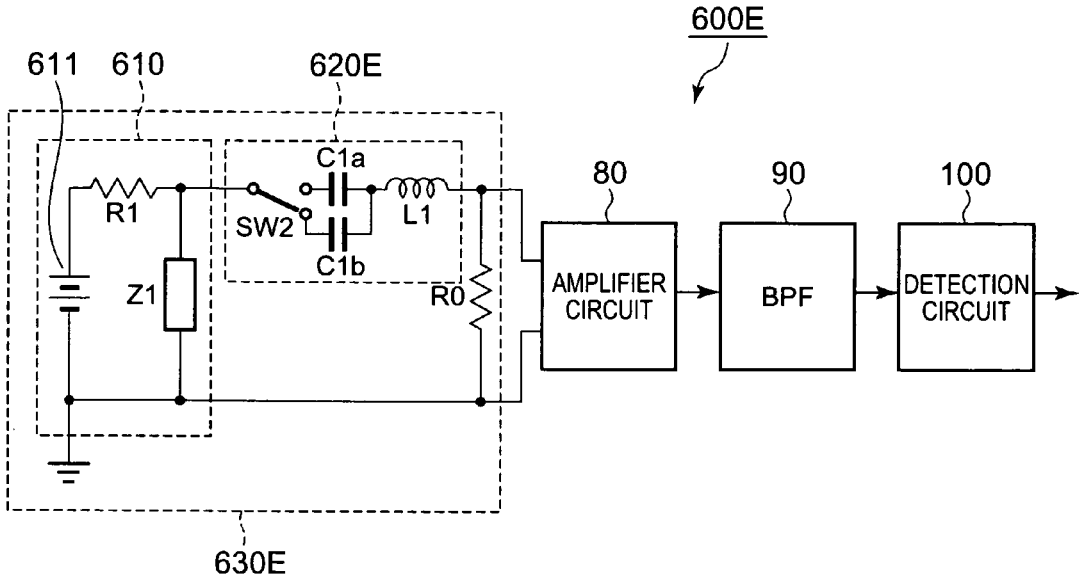
FIG. 29 is an example of circuit configuration of a reception control circuit section in which a receiving frequency is switchable.

FIG. 29 shows one example of a circuit configuration of a reception control circuit section 600E in which the modification is applied to the reception control circuit section 600A shown in FIG. 25. As shown in FIG. 29, the reception control circuit section 600E has a configuration that the resonant circuit 620A of the reception control circuit section 600A is replaced with a resonant circuit 620E.

The resonant circuit 620E has a configuration that two condensers C1*a* and C1*b* connected in parallel are connected with an inductor L1 and switch SW2 in series. The condensers C1*a* and C1*b* have different capacities from each other. The switch SW2 switches a connection to connect one of the condensers C1*a* and C1*b* with the inductor L1 in series, so as to switch resonant frequency of the resonant circuit 620E. Thus, the reception control circuit section 600E can receive two standard frequency broadcasts of different frequencies.

Figure 30:
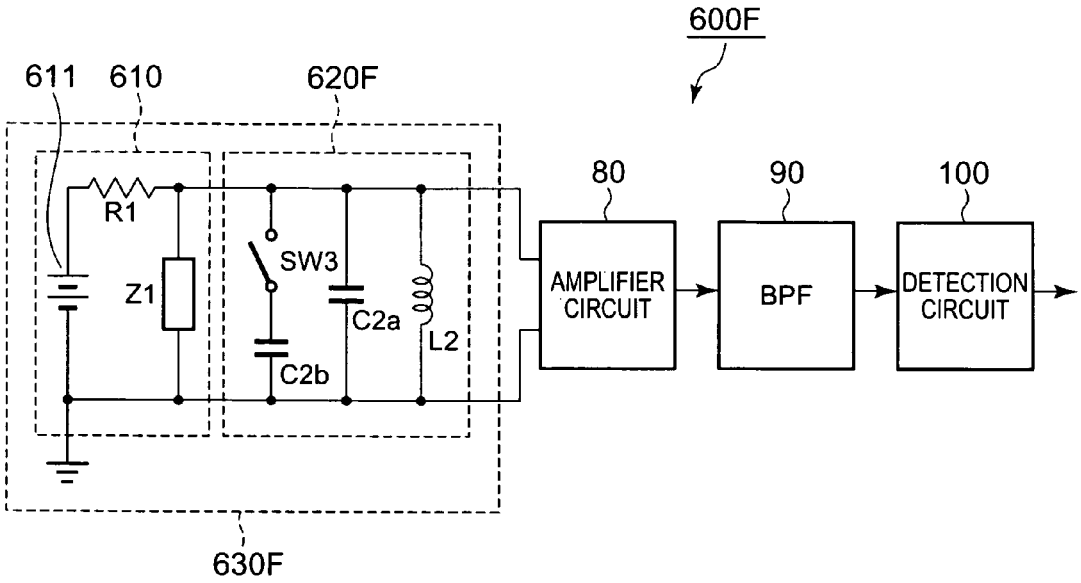
FIG. 30 is an example of circuit configuration of a reception control circuit section in which a receiving frequency is switchable.

FIG. 30 shows one example of a circuit configuration of a reception control circuit section 600F in which the modification is applied to the reception control circuit section 600B shown in FIG. 26. As shown in FIG. 30, the reception control circuit section 600F has a configuration that the antiresonant circuit 620B of the reception control circuit section 600B is replaced with an antiresonant circuit 620F.

The antiresonant circuit 620F has a configuration that two condensers C2*a* and C2*b* and an inductor L2 are connected in parallel and a switch SW3 is connected to the condenser C2*b* in series. The switch SW3 switches a connection to switch the resonant frequency of the antiresonant circuit 620F. Thus, the reception control circuit section 600F can receive two standard frequency broadcasts of different frequencies.

Figure 31:
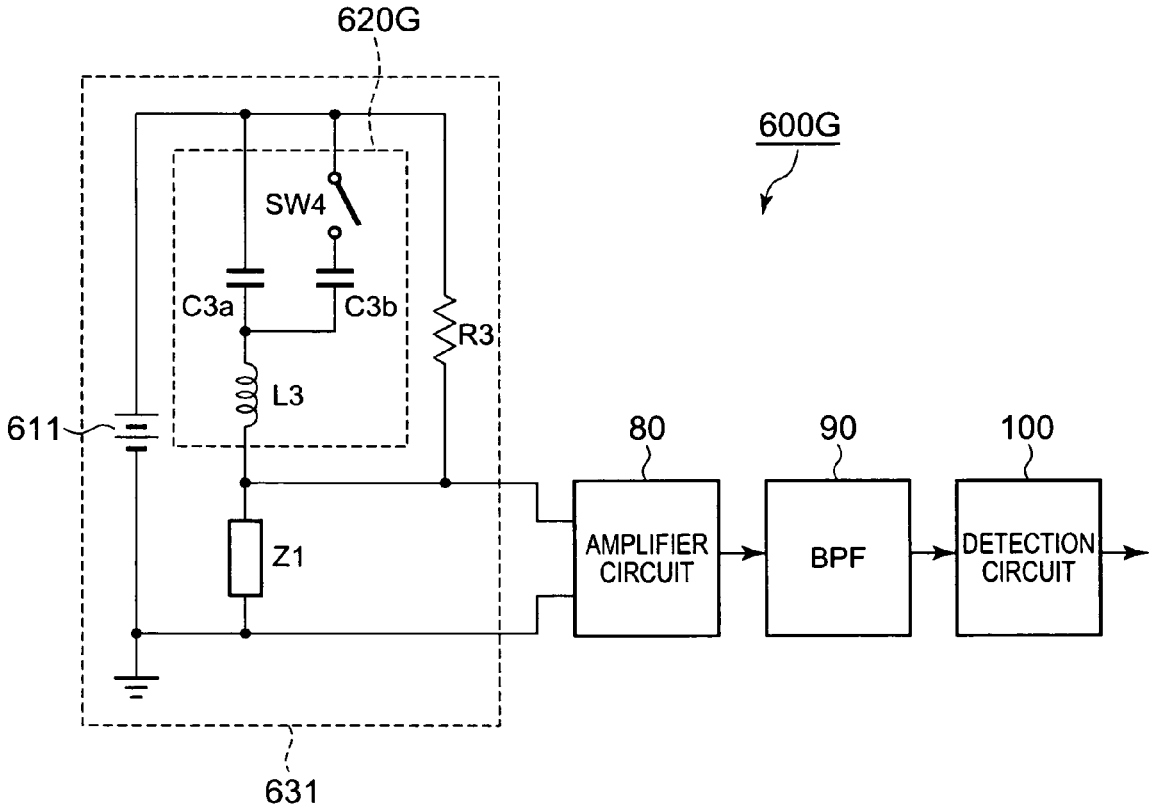
FIG. 31 is an example of circuit configuration of a reception control circuit section in which a receiving frequency is switchable.

FIG. 31 shows one example of a circuit configuration of a reception control circuit section 600G in which the modification is applied to the reception control circuit section 600C shown in FIG. 27. As shown in FIG. 31, the reception control circuit section 600G has a configuration that a resonant circuit 620C of the reception control circuit section 600C is replaced with a resonant circuit 620G.

The resonant circuit 620G has a configuration that condensers C3*a* and C3*b* connected in parallel is connected to an inductor L3 in series and a switch SW4 is connected to the condenser C3*b* in series. The switch SW4 switches a connection to switch the resonant frequency of the resonant circuit 620G. Thus, the reception control circuit section 600G can receive two standard frequency broadcasts of different frequencies.

(C) Magnetoresistance Element Z1

In the above-described embodiments, the magnetoresistance element Z1 is used in the magnetic sensor circuit 610. However, it may be a magnetic sensor using a spin tunneling magnetoresistance element or hall element, for example. When a hall element is used, resonant frequency of the resonant circuit can be equal to the carrier frequency of the intended standard frequency broadcast, since a hall element can detect direction and intensity of magnetic field.

The present invention is not limited to the above-described embodiments, and can be modified within the scope of the invention defined by the claims, and such modifications are also included in the scope of the present invention.

For example, in the first and second embodiments, level of an inversion signal of a radio-frequency signal which is applied to an adder can be adjusted with a resistance or the like.

Further, in the first and seventh embodiments, a radio-frequency signal generator S1' to generate rectangular wave can be used instead of the radio-frequency signal generator S1 to output a sine-wave radio-frequency signal, like the eight embodiment.

What is claimed is:

1. An antenna apparatus comprising:

a magnetic field detecting unit having an electric property which changes in accordance with a magnetic field change;

a radio-frequency signal generating unit which applies a radio-frequency signal to the magnetic field detecting unit;

a signal reducing unit which reduces a level of a first received signal obtained by the magnetic field detecting unit and the radio-frequency signal generating unit by an amount corresponding to a part of the radio-frequency signal, wherein the signal reducing unit includes: (i) an inverter which inverts the radio-frequency signal or a level-adjusted radio-frequency signal; and (ii) an adder which adds the first received signal and the inverted radio-frequency signal output from the inverter; and an envelope detecting unit which rectifies a second received signal that is obtained by reducing the level of the first received signal by the signal reducing unit, and which detects a signal indicating an envelope of a third received signal, that is obtained by rectifying the second received signal, by removing the radio-frequency signal from the third received signal.

2. The antenna apparatus according to claim 1, wherein the envelope detecting unit comprises a synchronous detection circuit which takes in the radio-frequency signal or the level-adjusted radio-frequency signal and which performs a synchronous detection with the taken-in signal.

3. The antenna apparatus according to claim 2, wherein the envelope detecting unit further comprises a rectangular wave generating unit which takes in the radio-frequency signal or the level-adjusted radio-frequency signal so as to generate a rectangular wave with the taken-in signal, and wherein the synchronous detection is performed with the rectangular wave.

4. A watch comprising:

the antenna apparatus according to claim 1;

a amplifier unit which amplifies a signal obtained by the antenna apparatus, the signal corresponding to a standard frequency broadcast including time information;

a detecting unit which detects a signal output from the amplifier unit so as to output a demodulated signal;

a time information extracting unit which extracts the time information from the demodulated signal;

a time counting unit which counts time;

a time display unit which displays the time counted by the time counting unit; and a time correcting unit which corrects the time counted by the time counting unit based on the time information extracted by the time information extracting unit.

* * * * *